US007314707B2

(12) United States Patent
Ihama et al.

(10) Patent No.: US 7,314,707 B2
(45) Date of Patent: Jan. 1, 2008

(54) SILVER HALIDE PHOTOGRAPHIC EMULSION

(75) Inventors: Mikio Ihama, Minami-Ashigara (JP); Hiroshi Kawakami, Minami-Ashigara (JP); Takayoshi Mori, Minami-Ashigara (JP)

(73) Assignee: FUJIFILM Corporation, Tokyo (JP)

( * ) Notice: Subject to any disclaimer, the term of this patent is extended or adjusted under 35 U.S.C. 154(b) by 38 days.

(21) Appl. No.: 09/955,438

(22) Filed: Sep. 19, 2001

(65) Prior Publication Data

US 2002/0068247 A1 Jun. 6, 2002

(30) Foreign Application Priority Data

Sep. 19, 2000 (JP) ..... 2000-284188
Jul. 17, 2001 (JP) ..... 2001-217073

(51) Int. Cl.
*G03C 1/005* (2006.01)

(52) U.S. Cl. ..... 430/567; 430/569

(58) Field of Classification Search ..... 430/567, 430/569

See application file for complete search history.

(56) References Cited

U.S. PATENT DOCUMENTS 5,250,403 A * 10/1993 Antoniades et al. ..... 430/505
5,494,789 A 2/1996 Daubendiek et al.
5,496,694 A 3/1996 Kikuchi et al.
5,534,399 A * 7/1996 Mihayashi ..... 430/553
5,536,632 A 7/1996 Wen et al.
5,582,965 A 12/1996 Deaton et al.
5,612,175 A 3/1997 Eshelman et al.
5,612,176 A 3/1997 Eshelman et al.
5,612,177 A 3/1997 Levy et al.
5,614,359 A 3/1997 Eshelman et al.
5,629,144 A 5/1997 Daubendiek et al.
5,631,126 A 5/1997 Daubendiek et al.
5,691,127 A 11/1997 Daubendiek et al.
5,698,387 A 12/1997 Reed et al.
5,723,278 A 3/1998 Jagannathan et al.
5,726,007 A 3/1998 Deaton et al.
5,792,601 A 8/1998 Edwards et al.
5,874,206 A * 2/1999 Kimura et al. ..... 430/565
5,919,611 A 7/1999 Maruyama
6,007,977 A 12/1999 Nishikawa
6,045,984 A 4/2000 Hoshino
6,090,535 A 7/2000 Morimura
6,100,019 A * 8/2000 Brust et al. ..... 430/569
6,153,370 A 11/2000 Maruyama et al.
6,225,041 B1 * 5/2001 Takada ..... 430/567
6,338,940 B1 1/2002 Miyazawa et al.

(Continued)

FOREIGN PATENT DOCUMENTS

JP 5-323485 A 12/1993

(Continued)

*Primary Examiner*—Amanda Walke
(74) *Attorney, Agent, or Firm*—Birch, Stewart, Kolasch & Birch, LLP

(57) ABSTRACT

A silver halide photographic emulsion comprising silver halide grains, wherein a variation coefficient of equivalent-circle diameters of all the silver halide grains is 30% or less, and 70% or more of the total projected area of the silver halide grains are occupied by silver halide grains each meeting requirements (i), (ii), and (iii) below:

(i) silver bromochloroiodide grain having (111) faces as main planes, (ii) having an epitaxial portion junctioned to at least one apex portion thereof, and (iii) having at least one dislocation line in an epitaxial portion thereof.

11 Claims, 1 Drawing Sheet

IHAK-404A#2
000016 400.0KV X50K 100nm

U.S. PATENT DOCUMENTS

| | | | | |
|---|---|---|---|---|
| 6,432,626 | B1 * | 8/2002 | Sugimoto et al. | 430/567 |
| 6,544,725 | B2 | 4/2003 | Morimoto | |
| 6,607,874 | B2 * | 8/2003 | Ihama et al. | 430/567 |

FOREIGN PATENT DOCUMENTS

| | | | |
|---|---|---|---|
| JP | 8-069069 | A | 3/1996 |
| JP | 8-101472 | A | 3/1996 |
| JP | 8-101473 | A | 3/1996 |
| JP | 8-101474 | A | 3/1996 |
| JP | 8-101475 | A | 3/1996 |
| JP | 8-101476 | A | 3/1996 |
| JP | 8-171162 | A | 3/1996 |
| JP | 8-171163 | A | 3/1996 |
| JP | 9-197595 | A | 7/1997 |
| JP | 9-319018 | A | 12/1997 |
| JP | 10-123689 | A | 5/1998 |
| JP | 10-062891 | A | 10/1998 |
| JP | 10-268456 | A | 10/1998 |
| JP | 10-307355 | A | 11/1998 |
| JP | 11-095348 | A | 4/1999 |
| JP | 11-194457 | A | 7/1999 |
| JP | 11-218886 | A | 8/1999 |
| JP | 11-352619 | A | 12/1999 |
| JP | 2000-019666 | A | 1/2000 |
| JP | 2000-267212 | A | 9/2000 |
| JP | 2000-321696 | A | 11/2000 |
| JP | 2001-066739 | A | 3/2001 |
| JP | 2001-092057 | A | 4/2001 |
| JP | 2001-235821 | A | 8/2001 |

* cited by examiner

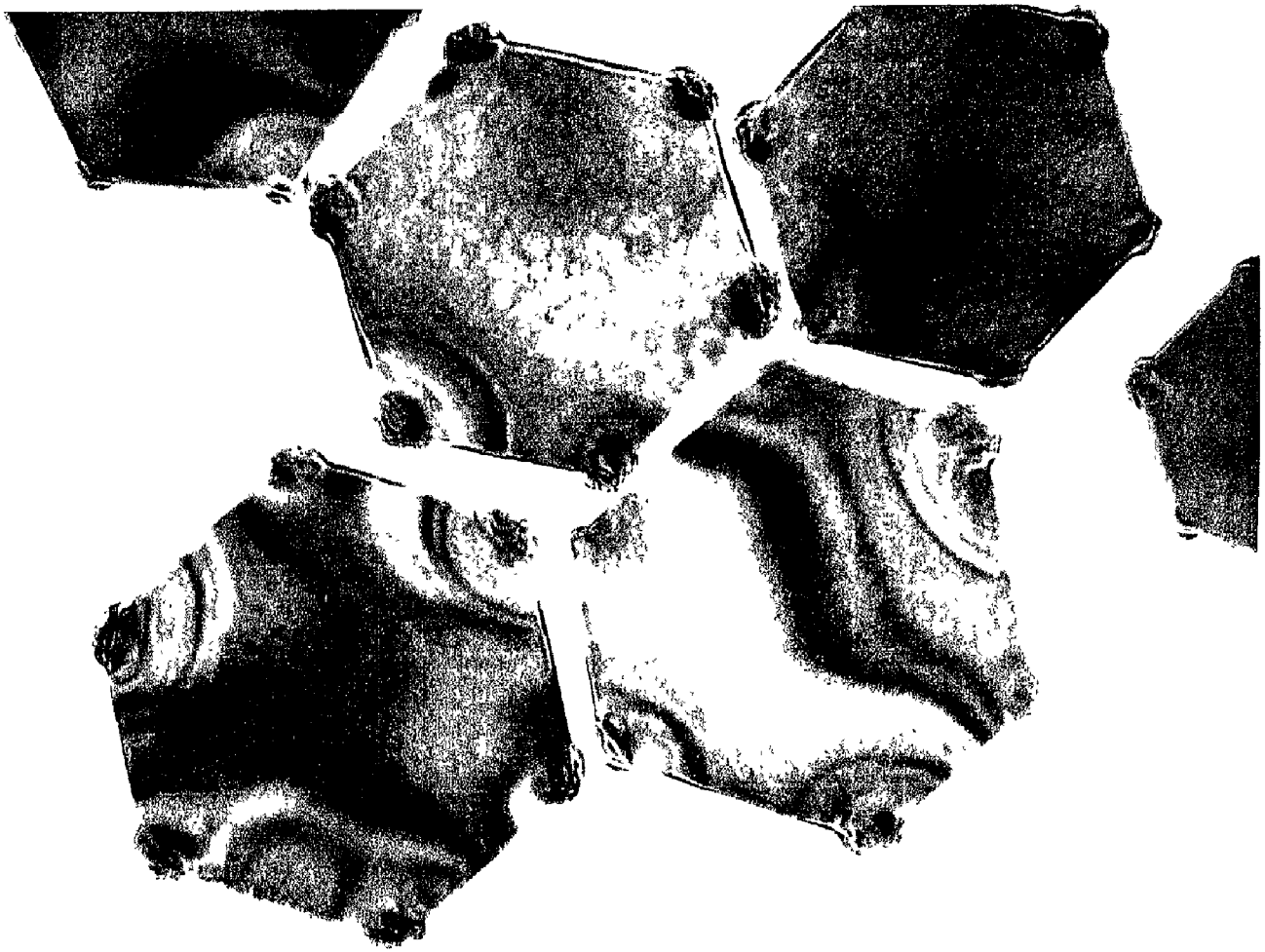
IHAK-404A#2
000016 400.0KV X50K 100nm
FIGURE

SILVER HALIDE PHOTOGRAPHIC EMULSION

CROSS-REFERENCE TO RELATED APPLICATIONS

This application is based upon and claims the benefit of priority from the prior Japanese Patent Applications No. 2000-284188, filed Sep. 19, 2000; and No. 2001-217073, filed Jul. 17, 2001, the entire contents of both of which are incorporated herein by reference.

BACKGROUND OF THE INVENTION

1. Field of the Invention

The present invention relates to a silver halide photographic light-sensitive material and a silver halide photographic emulsion used in the material and, more particularly, to a silver halide photographic emulsion and silver halide photographic light-sensitive material superior in storagebility and development dependence.

2. Description of the Related Art

The use of tabular silver halide grains (to be referred to as "tabular grains" hereinafter) to obtain a high-speed silver halide photographic light-sensitive material is well known to those skilled in the art. Methods of sensitizing these tabular grains by using epitaxial junctions are disclosed in Jpn. Pat. Appln. KOKAI Publication No. (hereinafter referred to as JP-A-)58-108526 and JP-A-59-133540. Also, applications to thinner tabular grains or to tabular grains having larger equivalent-circle diameters are disclosed in JP-A's-8-69069, 8-101472, 8-101474, 8-101475, 8-171162, 8-171163, 8-101473, 8-101476, 9-211762, and 9-211763, and U.S. Pat. Nos. 5,612,176, 5,614,359, 5,629,144, 5,631,126, 5,691,127, and 5,726,007. On the other hand, applications to tabular grains having smaller equivalent-circle diameters are disclosed in JP-A's-10-221798, 10-268457, and 10-339924. However, an epitaxial sensitization method using silver chloride as a principal constituent element is basically unstable in a light-sensitive material for photography constructed using silver iodobromide as a basic constituent element. The reason is that the solubility product of silver chloride is larger than that of silver iodide, so silver chloride readily undergoes halogen conversion. Therefore, a light-sensitive material using an epitaxial emulsion lowers its sensitivity or rises fog during storage. Additionally, the unstable solubility of an epitaxial portion varies the KBr amount during development, and this largely changes photographic properties. Hence, the method cannot be used for common light-sensitive materials for photography.

BRIEF SUMMARY OF THE INVENTION

The present inventors noted that epitaxial junctions largely vary between grains in conventional epitaxial emulsions. In addition, this variation is related to dislocation lines present in an epitaxial portion. Conventional epitaxial emulsions contain the following tabular grains as a mixture. That is, a mixture of tabular grains having one to six epitaxial junctions at their apexes, tabular grains having epitaxial junctions on their edges, tabular grains having epitaxial junctions on their main planes, and tabular grains having no epitaxial junctions. Furthermore, dislocation lines present in these epitaxial portions have larger variations.

The present inventors have found that the above problems can be solved by using tabular grains having conventionally unknown structures and compositions as substrates of epitaxial junctions, and using conventionally unknown preparation conditions during epitaxial junctions. Also, it was possible by the use of conventionally unknown gelatin to almost completely solve the problems of storable stability and processability of a light-sensitive material using an epitaxial emulsion.

The present invention is to provide a means capable of increasing the sensitivity of tabular grains and at the same time solving the problems of storagebility and processability.

That is, it is an object of the present invention to provide a silver halide photographic emulsion and photographic light-sensitive material having high sensitivity, good storagebility, and small dependence on processing conditions.

The above object was achieved by means (1) to (11) below.

(1) A silver halide photographic emulsion comprising silver halide grains, wherein a variation coefficient of equivalent-circle diameters of all the silver halide grains is 30% or less, and 70% or more of the total projected area of the silver halide grains are occupied by silver halide grains each meeting requirements (i), (ii), and (iii) below:

(i) silver bromochloroiodide tabular grain having (111) faces as main planes, (ii) having an epitaxial portion junctioned to at least one apex portion thereof, and (iii) having at least one dislocation line in an epitaxial portion thereof.

(2) A silver halide photographic emulsion comprising silver halide grains, wherein a variation coefficient of equivalent-circle diameters of all the silver halide grains is 30% or less, and 70% or more of the total projected area of the silver halide grains are occupied by silver halide grains each meeting requirements (i), (ii), and (iii') below:

(i) silver bromochloroiodide tabular grain having (111) faces as main planes, (ii) having an epitaxial portion junctioned to at least one apex portion thereof, and (iii') having mesh-like dislocation lines in an epitaxial portion thereof.

(3) A silver halide photographic emulsion comprising silver halide grains, wherein a variation coefficient of equivalent-circle diameters of all the silver halide grains is 30% or less, and 70% or more of the total projected area of the silver halide grains are occupied by silver halide grains each meeting requirements (i), (ii'), and (iii) below:

(i) silver bromochloroiodide tabular grain having (111) faces as main planes, (ii') having epitaxial portions junctioned to all apex portions thereof, and (iii) having at least one dislocation line in an epitaxial portion thereof.

(4) The silver halide photographic emulsion according to any one of items (1) to (3) above, wherein 70% or more of the total projected area of the silver halide grains are occupied by silver halide grains each meeting requirement (iv) below in addition to the three requirements defined in each of items (1) to (3) above:

(iv) having no dislocation lines in portions except for the epitaxial portions thereof.

(5) The silver halide photographic emulsion according to any one of items (1) to (3) above, wherein 70% or more of the total projected area of the silver halide grains are occupied by silver halide grains each meeting requirements (v), (vi), and (vii) below, in addition to the three requirements defined in each of items (1) to (3) above:

(v) the equivalent-circle diameter is 0.3 to 1.2 μm, (vi) the silver chloride content is 1 to 6 mol %, and (vii) an amount of an outermost layer thereof containing 10 mol % or more of silver iodide is 20% or less in terms of silver.

(6) The silver halide photographic emulsion according to any one of items (1) to (3) above, wherein 70% or more of the total projected area of the silver halide grains are occupied by silver halide grains each meeting requirement (viii) below, in addition to the three requirements defined in each of items (1) to (3) above:

(viii) hexagonal tabular grain in which the ratio of the length of an edge having a maximum length to the length of an edge having a minimum length is 2 or less.

(7) The silver halide photographic emulsion according to any one of items (1) to (3) above, wherein 70% or more of the total projected area of the silver halide grains are occupied by silver halide grains each meeting requirement (ix) below, in addition to the three requirements defined in each of items (1) to (3) above:

(ix) the thickness is 0.1 μm or less.

(8) The silver halide photographic emulsion according to item (1) above, wherein the variation coefficient of equivalent-circle diameters of all the silver halide grains is 20% or less.

(9) The silver halide photographic emulsion according to any one of items (1) to (3) above, wherein 70% or more of the total projected area of the silver halide grains are occupied by silver halide grains each meeting requirement (x) below, in addition to the three requirements defined in each of items (1) to (3) above:

(x) letting CL mol % be the average silver chloride content of all the silver halide grains, the silver chloride content is within a range of 0.7CL to 1.3CL.

(10) The silver halide photographic emulsion according to any one of items (1) to (3) above, wherein 70% or more of the total projected area of the silver halide grains are occupied by silver halide grains each meeting requirement (xi) below, in addition to the three requirements defined in each of items (1) to (3) above:

(xi) letting I mol % be the average silver iodide content of all the silver halide grains, the silver iodide content is within a range of 0.7I to 1.3I.

(11) A silver halide photographic lightsensitive material having at least one lightsensitive silver halide emulsion layer on a support, wherein the emulsion layer contains the emulsion according to any one of items (1) to (3).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The single FIGURE is a electron micrograph of a representative silver halide emulsion of the invention. The magnification is 100,000-fold.

DETAILED DESCRIPTION OF THE INVENTION

A silver halide photographic emulsion of the present invention will be described below.

In the present invention, a tabular grain is a silver halide grain having two opposing parallel (111) main planes. A tabular grain used in the present invention has one twin plane or two or more parallel twin planes. The twin plane is a (111) plane on the two sides of which ions at all lattice points have a mirror image relationship.

When viewed in a direction perpendicular to its main planes, the tabular grain has a triangular shape, a hexagonal shape, or a rounded triangular or hexagonal shape. Each of these shapes has parallel outer surfaces.

In the emulsion of the present invention, 70% or more of the projected area of all grains are preferably hexagonal tabular grains in which the ratio of the length of an edge having a maximum length to the length of an edge having a minimum length is 2 to 1. More preferably, 90% or more of the projected area of all grains are hexagonal tabular grains in which the ratio of the length to an edge having a maximum length to the length of an edge having a minimum length is 2 to 1. Much more preferably, 90% or more of the projected area of all grains are hexagonal tabular grains in which the ratio of the length to an edge having a maximum length to the length of an edge having a minimum length is 1.5 to 1. If the shape of the main plane of a tabular grain is a rounded triangle or hexagon, the length of an edge of this main plane is the length of a virtual triangle or hexagon formed by extending the edges. Mixing of tabular grains other than the above-mentioned hexagonal grains makes the preparation of an epitaxial emulsion of the present invention difficult. This makes it difficult to solve the problems of storagebility and processing dependence.

In the emulsion of the present invention, a variation coefficient of equivalent-circle diameters of all grains is 30% or less.

The emulsion of the present invention is preferably monodisperse. In the present invention, the variation coefficient of the equivalent-circle diameters of the projected areas of all silver halide grains is preferably 25% or less, and particularly preferably, 20% or less. The variation coefficient of equivalent-circle diameters is the value obtained by dividing the standard deviation of the distribution of the equivalent-circle diameters of individual silver halide grains by their average equivalent-circle diameter. If the monodispersibility worsens, epitaxial deposition becomes nonuniform between grains. This makes the preparation of an epitaxial emulsion of the present invention difficult.

The equivalent-circle diameters of tabular grains are obtained by taking a transmission electron micrograph by using, e.g., the replica method, and calculating the diameter (equivalent-circle diameter) of a circle having an area equal to the projected area of each grain. The thickness of a grain cannot be simply calculated from the shadow of a replica owing to epitaxial deposition. However, the thickness can be calculated by measuring the length of the shadow of a replica before epitaxial deposition. Alternatively, even after epitaxial deposition the thickness can be readily obtained by cutting a sample coated with tabular grains and taking an electron micrograph of the section of the sample.

In the tabular grains of the present invention, 70% or more of the total projected area are those having an equivalent-circle diameter of preferably 0.3 to 1.2 μm, and more preferably, 0.5 to 1.0 μm. Particularly preferably, 70% or more of the total projected area are tabular grains having a thickness of 0.1 μm or less. Generally, as the equivalent-circle diameter decreases and the thickness decreases, the number of grains increases, and this usually broadens the inter-grain distribution of epitaxial deposition. However, the emulsion of the invention has narrow inter-grain distribution of epitaxial deposition even the grains contained therein have small equivalent circle diameters and thin thickness.

The silver halide composition of the tabular grain used in the present invention is silver bromochloroiodide. Basically, a host tabular grain is made of silver bromoiodide or silver bromochloroiodide, and an epitaxial portion is made of the combination of silver chloride, silver bromochloride, or silver bromochloroiodide. The silver chloride content is preferably 1 to 6 mol %, and more preferably, 2 to 5 mol %. The silver iodide content is preferably 2 mol % or more, and more preferably, 2 to 10 mol %.

In the host tabular grain of the present invention, an outermost layer containing 10 mol % or more of silver iodide is preferably 20% or less in terms of a silver amount. The silver iodide content of the outermost layer is mol % with respect to silver in this outermost layer. Although a structure inside the outermost layer is arbitrary, the silver iodide content is basically smaller than that of the outermost layer. The outermost layer is preferably 5% to 20% in terms of a silver amount. More preferably, the outermost layer is 10% to 15%. The silver iodide content of the outermost layer is favorably 15 to 30 mol %. If the silver iodide content falls outside this range, epitaxial deposition becomes nonuniform between grains, so no dislocation lines are introduced. Consequently, the effect of the present invention cannot be easily obtained.

In the present invention, letting CL mol % be the average silver chloride content of all silver halide grains, 70% or more of the total projected area are grains in which the silver chloride content is preferably 0.7CL to 1.3CL, and particularly preferably, 0.8CL to 1.2CL. In an emulsion of the present invention, epitaxial deposition is uniform between grains, so the distribution of the silver chloride contents between the grains is basically monodisperse. More preferably, letting I mol % be the average silver iodide content of all silver halide grains, 70% or more of the total projected area are grains in which the silver iodide content is preferably 0.7I to 1.3I, and particularly preferably, 0.8I to 1.2I. By letting the distribution of the silver iodide contents between grains monodisperse, epitaxial deposition between grains becomes uniform. The EPMA (Electron Probe Micro Analyzer) method is usually effective in the measurement of the silver chloride content and silver iodide content of each individual grain. By forming a sample in which emulsion grains are dispersed so as not to contact each other, and analyzing X-rays radiated by radiating an electron beam to the grains, elements in a micro region irradiated with the electron beam can be analyzed. The measurement is preferably performed at low temperatures in order to prevent damage to the sample by the electron beam.

In the emulsion of the present invention, 70% or more of the total projected area are occupied by tabular grains each having an epitaxial portion junctioned to at least one apex portion thereof. More preferably, 90% or more of the total projected area are occupied by tabular grains each having an epitaxial portion junctioned to at least one apex portion thereof. The apex portion means a portion in a fan shape which is defined by an apex and two edges forming this apex and which has a radius ⅓ the length of a shorter one of these two edges, when a tabular grain is viewed in a direction perpendicular to its main planes. A grain having an epitaxial portion junctioned to at least one of these apex portions, and having epitaxial portions junctioned to each of a maximum of six apex portions, is the epitaxial emulsion of the present invention. If the shape of the main plane of a tabular grain is a rounded triangle or hexagon, the apexes and edges of the main plane are the apexes and edges of a virtual triangle or hexagon formed by extending the edges. Usually, epitaxial portions are junctioned on the main planes or on edges except for the apex portions of a tabular grain, as well as on the apex portions of a tabular grain such as the epitaxial emulsion of the present invention.

The epitaxial emulsion of the present invention can be discriminated as follows. 100 or more grains are extracted at random from an electron micrograph of replicas of tabular grains and classified into three types of grains: (i) a grain having an epitaxial portion junctioned to one or more apex portions; (ii) a grain having an epitaxial portion junctioned only on edges, except for the portions of the edges constituting the apex portion, or on the main planes, except for the apex portions; and (iii) a grain having no epitaxial portion junctioned thereto. An emulsion in which 70% or more of the projected area are the grains of (i), i.e., grains each having an epitaxial portion junctioned to one or more apex portions, is the epitaxial emulsion of the present invention. More preferably, 90% or more of the total projected area are grains of (i), are the preferable epitaxial emulsion of the present invention.

The epitaxial portion is silver chloride, silver bromochloride, or silver bromochloroiodide. The silver chloride content of this epitaxial portion is higher by preferably 1 mol % or more, and more preferably, 10 mol % or more, than that of a host tabular grain. However, the silver chloride content of the epitaxial portion is preferably 50 mol % or less. The silver bromide content of the epitaxial portion is preferably 30 mol % or more, and particularly preferably, 50% or more. The silver iodide content of the epitaxial portion is preferably 1 to 20 mol %. The silver amount in the epitaxial portion is preferably 1 to 10 mol %, and more preferably, 2 to 7 mol % of the silver amount in a host tabular grain.

In the emulsion of the present invention, 70% or more of the total projected are occupied by tabular grains having at least one dislocation line per grain in the epitaxial portion thereof. Preferably, 80% or more of the total projected area are occupied by tabular grains having at least one dislocation line per grain in the epitaxial portion thereof. More preferably, in an emulsion of the present invention 70% of more of the total projected area are occupied by tabular grains having mesh-like dislocation lines in the epitaxial portion. Most preferably, 80% or more of the total projected area are occupied by mesh-like dislocation lines in the epitaxial portion. Mesh-like dislocation lines are a plurality of uncountable dislocation lines crossing each other like a mesh. In a tabular grain having epitaxial portions junctioned to two or more apex portions, dislocation lines do not necessarily exist in each epitaxial portion. An emulsion in which the epitaxial portion junctioned to at least one apex portion contains one dislocation line, and preferably, mesh-like dislocation lines, is the epitaxial emulsion of the present invention. Preferably, 70% or more of the total projected area is occupied by grains having mesh-like dislocation lines on at least one of the epitaxial portions.

In the present invention it is preferable that 70% or more of the total projected area are occupied by grains having no dislocation lines in portions except for the epitaxial portions. Dislocation lines provide preferential deposition sites of epitaxial deposition and inhibit the formation of epitaxial tabular grains of the present invention. Most preferably, 90% or more of the total projected area are occupied by grains in which the number of dislocation lines is zero in portions except for the epitaxial portions. Dislocation lines in tabular grains can be observed by a direct method using a transmission electron microscope at a low temperature described in, e.g., J. F. Hamilton, Phot. Sci. Eng., 11, 57, (1967) or T.

Shiozawa, J. Soc. Phot. Sci. Japan, 35, 213, (1972). That is, silver halide grains, extracted carefully from an emulsion so as not to apply a pressure at which dislocation lines are produced in the grains, are placed on a mesh for electron microscopic observation. Observation is performed by a transmission method while the sample is cooled to prevent damage (e.g., printout) due to an electron beam. In this case, as the thickness of a grain increases, it becomes more difficult to transmit an electron beam through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocation lines in each grain viewed in a direction perpendicular to the main planes of the grain.

In the emulsion of the present invention, preferably 70% or more, and more preferably, 80% or more of the total projected area are occupied by tabular grains which do not epitaxially junction stepwise onto the main planes in the apex portions of host tabular grains, but which epitaxially junction by extending to side faces of host tabular grains. A tabular grain which epitaxially junctions by extending from apexes of the main planes to side faces of a host tabular grain is distinguished as follows from a tabular grain which epitaxially junctions stepwise onto the main planes in apex portions of a host tabular grain. 100 or more grains are extracted at random from an electron micrograph of tabular grains taken by the replica method. A grain in which the area of portions not overlapping the apex portions and extending to side faces accounts for 60% or more of the total projected area of the epitaxial portions of that grain is defined as a tabular grain which epitaxially junctions by extending to side faces of a host tabular grain. If control is not performed so as to keep this shape after epitaxial deposition, dislocation lines disappear because the epitaxial junction is rearranged.

The epitaxial tabular emulsion of the present invention meeting the above conditions can lower its pBr. The pBr is the logarithm of the reciprocal of a bromine ion concentration. Since the pBr at 40° C. can be decreased to 3.5 or less, the storagebility can be significantly improved. Additionally, the problem of processing dependence can be solved because the emulsion can be incorporated into a light-sensitive material for photography which is constructed using silver bromoiodide as a basic constituent element. The pBr at 40° C. of an emulsion of the present invention is more preferably 3.0 or less, and most preferably, 2.5 or less.

Particular process for preparing the above epitaxial tabular grains of the present invention will be described in detail below in two parts, the one for the preparation of host tabular grains and the other for the preparation of epitaxial portions.

First, the host tabular grains required for the preparation of the epitaxial tabular grains will be described. With respect to the intragranular distribution of silver iodide in the host tabular grains of the present invention, grains of double or more multiple structures are preferred. Herein, the expression "having structures with respect to the distribution of silver iodide" means that there is a difference in silver iodide content of 0.5 mol % or more, preferably 1 mol % or more, between structures. The "outermost layer" of a host tabular grain used in the present invention is the outermost layered phase in the multiple structures with respect to the silver iodide distribution.

Structures with respect to the distribution of silver iodide can fundamentally be determined by calculation from formulation values for the step of grain preparation. The change of silver iodide content at each interface of structures can be sharp or gentle. In the ascertation thereof, although an analytical measuring precision must be considered, the aforementioned EPMA method is effective. This method enables analyzing the intragranular silver iodide distribution as viewed from a position perpendicular to the main plane of tabular grains. Further, by using a specimen obtained by hardening the grain specimen and slicing the hardened specimen with the use of a microtome into extremely thin sections, the method also enables analyzing the intragranular silver iodide distribution across the tabular grain section.

In the host tabular grains, it is preferred that the silver iodide content of the outermost layer of the tabular grain be preferably 10 mol % or more. The ratio of the outermost layer is preferably 20 mol % or less, and more preferably 5 to 20 mol % based on the total silver quantity. The silver iodide content thereof is in the range of 15 to 30 mol %. Herein, the ratio of the outermost shell refers to the ratio of the amount of silver used in the preparation of the outermost shell to the amount of silver used for obtaining final grains. The silver iodide content refers to the molar ratio % of the amount of silver iodide used in the preparation of the outermost layer to the amount of silver used in the preparation of the outermost layer. The distribution thereof may be uniform or nonuniform. When the distribution of silver iodide content is nonuniform, the iodide content is an average value in the outermost layer. More preferably, the ratio of outermost layer is in the range of 10 to 15 mol % based on the total silver quantity, and the average silver iodide content thereof is in the range of 15 to 25 mol %.

The preparation of host tabular grains fundamentally consists of a combination of three steps, namely, nucleation, ripening and growth.

In the step of nucleation of grains for use in the present invention, it is extremely advantageous to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the present invention, most preferably, an aqueous solution of silver nitrate, an aqueous solution of halide and an oxidation-processed gelatin of low molecular weight are added within one minute at 20 to 40° C. under agitation in the presence of oxidation-processed gelatin of low molecular weight. At that time, the pBr and pH values of the system are preferably 2 or higher and 7 or below, respectively. The concentration of the aqueous solution of silver nitrate is preferably 0.6 mol/L or less. The employment of this nucleation method facilitates the formation of the epitaxial tabular grains of the present invention.

In the step of ripening the tabular grain emulsion of the present invention, it is practical to effect ripening in the presence of low-concentration base as described in U.S. Pat. No. 5,254,453, and to carry out ripening at high pH as described in U.S. Pat. No. 5,013,641. It is also practical to add, at the step of ripening or subsequent growth, polyalkylene oxide compounds as described in U.S. Pat. Nos. 5,147,771, 5,147,772, 5,147,773, 5,171,659, 5,210,013 and 5,252,453. In the present invention, the ripening step is preferably performed at 50 to 80° C. Immediately after the nucleation or during the ripening, the pBr is preferably lowered to 2 or below. Additional gelatin is preferably added from immediately after the nucleation to the end of ripening. Most preferred gelatin is one having 95% or more of its amino groups modified into succinate or trimellitate. The employment of such gelatins facilitates the formation of the epitaxial tabular grains of the present invention.

In the step of growth for the present invention, it is preferably employed to simultaneously add an aqueous solution of silver nitrate, an aqueous solution of halide containing a bromide and a silver iodide fine grain emulsion as described in U.S. Pat. Nos. 4,672,027 and 4,693,964. The silver iodide fine grain emulsion is not limited if it consists substantially of silver iodide, and may contain silver bromide and/or silver chloride as long as mixed crystals can be formed. Preferably, the silver halide composition of the silver iodide fine grain emulsion consists of 100% silver iodide. With respect to the crystalline structure, the silver iodide can have not only β form and γ form but also, as described in U.S. Pat. No. 4,672,026, α form or a structure similar thereto. In the present invention, although the crystalline structure is not particularly limited, it is preferred to employ a mixture of β form and γ form, more preferably β form only. Although the silver iodide fine grain emulsion may be one prepared immediately before the addition as described in, for example, U.S. Pat. No. 5,004,679, or one having undergone the customary washing. The silver iodide fine grain emulsion can be easily prepared by the methods as described in, for example, U.S. Pat. No. 4,672,026. The method of adding an aqueous solution of silver salt and an aqueous solution of iodide by double jet, wherein the grain formation is carried out at a fixed pI value, is preferred. The terminology "pI" used herein means the logarithm of inverse of I ion concentration of the system. Although there is no particular limitation with respect to the temperature, pI, pH, type of protective colloid agent such as gelatin, concentration thereof, presence of silver halide solvent, type and concentration thereof, etc., it is advantageous in the present invention that the grain size be 0.1 μm or less, preferably 0.07 μm or less. Although the grain configuration cannot be fully specified because of the fine grains, it is preferred that the variation coefficient of the grain size distribution be 25% or less. When it is 20% or less, the effect of the present invention is especially striking. The size and size distribution of the silver iodide fine grain emulsion are determined by placing silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of observed grain. With respect to the grain size distribution as well, it is determined by the use of the above diameter of a circle having the same projected area. In the present invention, the most effective silver iodide fine grains have a grain size of 0.06 to 0.02 μm and exhibit a variation coefficient of grain size distribution of 18% or less.

After the above grain formation, the silver iodide fine grain emulsion is preferably subjected to, as described in, for example, U.S. Pat. No. 2,614,929, the customary washing and the regulation of pH, pI and concentration of protective colloid agent such as gelatin and regulation of concentration of contained silver iodide. The pH is preferably in the range of 5 to 7. The pI value is preferably set at one minimizing the solubility of silver iodide or one higher than the same. Common gelatin having an average molecular weight of about 100 thousand is preferably used as the protective colloid agent. Also, low-molecular-weight gelatins having an average molecular weight of 20 thousand or less are preferably used. There are occasions in which the use of a mixture of such gelatins having different molecular weights is advantageous. The gelatin amount per kg of emulsion is preferably in the range of 10 to 100 g, more preferably 20 to 80 g. The silver quantity in terms of silver atom per kg of emulsion is preferably in the range of 10 to 10 g, more preferably 20 to 80 g. Although the silver iodide fine grain emulsion is generally dissolved prior to the addition, it is requisite that the agitating efficiency of the system be satisfactorily high at the time of the addition. The agitation rotating speed is preferably set higher than usual. The addition of an antifoaming agent is effective in preventing the foaming during the agitation. Specifically, use is made of antifoaming agents set forth in, for example, Examples of U.S. Pat. No. 5,275,929.

The method most preferably employed in the growth step for the invention is one described in JP-A-2-188741. In the growth of tabular grains, an ultrafine grain emulsion of silver bromide, silver iodobromide or silver iodochlorobromide, prepared just before the addition, is continuously added so that the ultrafine grain emulsion is dissolved to thereby accomplish growth of tabular grains. An external mixer for preparing the ultrafine grain emulsion has high agitation capacity, and an aqueous solution of silver nitrate, an aqueous solution of halide and gelatin are fed into the external mixer. Gelatin can be mixed with an aqueous solution of silver nitrate and/or an aqueous solution of halide in advance or just before the addition. Also, an aqueous solution of gelatin can be added alone. Gelatins having a molecular weight smaller than the ordinary are preferred. It is especially preferred that the molecular weight thereof be in the range of 10,000 to 50,000. Gelatin having 90% or more of its amino groups modified into phthalate, succinate or trimellitate and/or oxidation-processed gelatin of reduced methionine content can especially preferably be used. The use of this growth method facilitates the formation of the epitaxial tabular grains of the present invention.

It is especially preferred in the present invention that 75% or less of all the side faces connecting the opposite (111) main planes of host tabular grains consist of (111) faces.

The expression "$_{75}$% or less of all the side faces consist of (111) faces" used herein means that crystallographic faces other than the (111) faces are present at a ratio higher than 25% based on all the side faces. The other faces, although generally understandable as consisting of (100) faces, are not limited thereto and can comprise (110) faces and faces of higher indices. The effect of the present invention is remarkable when 70% or less of all the side faces consist of (111) faces.

Whether 75% or less of all the side faces consist of (111) faces or not can easily be judged from an electron micrograph obtained by the carbon replica method in which the tabular grain is shadowed. When at least 75% of all the side faces consist of (111) faces, with respect to a hexagonal tabular grain, six side faces directly connected to the (111) main planes are generally alternately connected to the (111) main planes with acute angles and obtuse angles. On the other hand, when 75% or less of all the side faces consist of (111) faces, with respect to a hexagonal tabular grain, six side faces directly connected to the (111) main planes are all connected to the (111) main planes with obtuse angles. Whether the side faces are connected to the main planes with acute angles or with obtuse angles can be judged by effecting the shadowing at an angle of 50° or less. Preferably, the judgment between acute angles and obtuse angles is facilitated by effecting the shadowing at an angle of 30° to 10°.

The method of utilizing the adsorption of a sensitizing dye is effective in determining the ratio of (111) faces to (100) faces. The ratio of (111) faces to (100) faces can be quantitatively determined by the application of the method described in Journal of the Chemical Society of Japan, 1984, vol. 6, pp. 942-947. The ratio of (111) faces to all the side faces can be calculated from the above ratio of (111) faces to (100) faces and the aforementioned equivalent circle diameter and thickness of the tabular grain. In this instance, the tabular grain is assumed as a cylinder with the equivalent circle diameter and thickness. Under this assumption, the ratio of the side faces to the total surface area can be determined. The ratio of (100) faces to all the side faces is a value obtained by dividing the above ratio of (100) faces determined on the basis of the adsorption of sensitizing dye by the above side face ratio and multiplying the resultant quotient by 100. The ratio of (111) faces to all the side faces is determined by subtracting this value from 100. In the present invention, it is more preferred that the ratio of (111) faces to all the side faces be 65% or less.

The method for causing 75% or less of all the side faces of the host tabular grain emulsion to consist of (111) faces will now be described. Most generally, the ratio of (111) faces to the side faces of the host tabular grain emulsion can be can be regulated by pBr at the preparation of the tabular grain emulsion. Preferably, 30% or more of the silver quantity required for the formation of the outermost layer is added at a pBr set so that the ratio of (111) faces to the side faces is decreased, that is, the ratio of (100) faces to the side faces is increased. More preferably, 50% or more of the silver quantity required for the formation of the outermost layer is added at a pBr set so that the ratio of (111) faces to the side faces is decreased.

As an alternative method, after the addition of the whole silver quantity, pBr is so set that the ratio of (100) faces to the side faces is increased, followed by ripening to thereby attain an increase of the ratio.

With respect to such pBr as will increase the ratio of (100) faces to the side faces, the value thereof can be widely varied depending on the temperature and pH of system, type of protective colloid agent such as gelatin, concentration thereof, presence of silver halide solvent, type and concentration thereof, etc. Generally, it is preferred that the pBr be in the range of 2.0 to 5. More preferably, the pBr is in the range of 2.5 to 4.5. However, as mentioned above, this pBr value can be easily changed, for example, depending on the presence of a silver halide solvent, etc. Examples of silver halide solvents which can be used in the present invention include organic thioethers (a) described in U.S. Pat. Nos. 3,271,157, 3,531,286 and 3,574,628 and JP-A's-54-1019 and 54-158917, thiourea derivatives (b) described in JP-A's-53-82408, 55-77737 and 55-2982, silver halide solvents having a thiocarbonyl group interposed between an oxygen or sulfur atom and a nitrogen atom (c) described in JP-A-53-144319, imidazoles (d) described in JP-A-54-100717, sulfites (e), ammonia (f) and thiocyanates (g).

Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halides.

With respect to the method of changing the face index for the side faces of the tabular grain emulsion, reference can be made to, for example, EP No. 515894A1. Further, use can be made of polyalkylene oxide compounds described in, foe example, U.S. Pat. No. 5,252,453. As an effective method, there can be mentioned the use of face index improvers described in, for example, U.S. Pat. Nos. 4,680,254, 4,680,255, 4,680,256 and 4,684,607. Conventional photographic spectral sensitizing dyes can also be used as similar face index improvers.

It is preferred that the host tabular grains have no dislocation lines. Dislocation lines can be vanished by the use of the above nucleation, ripening and growth steps in combination.

Epitaxial junctions necessary for the preparation of the epitaxial emulsion of the present invention will be described in detail below. Epitaxial deposition can be performed immediately after the formation of host tabular grains, or after normal desalting is performed after the formation of host tabular grains. Before this epitaxial deposition, an emulsion favorably contains gelatin which, in a molecular weight distribution measured on the basis of the PAGI method, contains 5% to 30% of a high-molecular-weight component having a molecular weight of approximately 2,000,000 or more and 55% or less of a low-molecular-weight component having a molecular weight of approximately 100,000 or less, hereinafter the gelatin meeting the requirements is also referred to as "high-molecular-weight gelatin". Particularly favorably, the emulsion contains gelatin which, in the molecular weight distribution measured on the basis of the PAGI method, contains 5% to 15% of a high-molecular-weight component having a molecular weight of approximately 2,000,000 or more and 50% or less of a low-molecular-weight component having a molecular weight of approximately 100,000 or less. When epitaxial junction is performed, the high-molecular-weight gelatin having the above defined components is contained in an amount of 10 wt. %, preferably, 30 wt. % or more, and more preferably, 50 wt. % or more of the total gelatin amount. Although the addition of this gelatin before coating is effective, the effect is small. Details of high-molecular-weight gelatin important in the preparation of an epitaxial emulsion of the present invention will be explained below.

Gelatin used in the emulsion of the present invention (to be also referred to as "gelatin of the present invention" hereinafter) is formed by giving water solubility to a collagen tissue by decomposing its structure with alkali or acid. Alkali-processed gelatin consists, on the basis of its molecular weight, of sub-α (low molecular weight), α (molecular weight=about 100,000), β (molecular weight=about 200,000), γ (molecular weight=about 300,000), and void (higher molecular weight).

The ratio of gelatin components, i.e., the molecular weight distribution in the present invention is measured by gel permeation chromatography (to be referred to as "GPC" hereinafter) on the basis the PAGI method which is internationally determined. Details of GPC are described in, e.g., Takashi Ohno, Yukihiro Kobayashi, and Shinya Mizusawa, "The Journal of Japan Photographic Society", Vol. 47, No. 4, 1984, pp. 237 to 247.

The measurement conditions of the molecular weight distribution of gelatin according to the present invention are presented below.

(Measurement Conditions)

Column: Shodex Asahipak GS-620 7G (8 mm I.D.×500 mm)×2

Guard column: Shodex Asahipack GS-1G 7B

Eluting solution: 0.2 mol/litter phosphoric acid buffer (pH 6.8)

Flow rate: 0.8 milliliter/min

Column temperature: 50° C.

Detection: UV 230 nm

Sample concentration: 0.5 wt %

On a GPC curve obtained by plotting the retention time on the abscissa and the absorbance on the ordinate, the peak of the exclusion limit first appears, and then the peaks of the β and α components of gelatin appear. The curve forms a long tail as the retention time prolongs.

In the present invention, the ratio occupied by a high-molecular-weight component having a molecular weight of about 2,000,000 or more is obtained by calculating the ratio which the area of the peak of the exclusion limit accounts for in the whole area. More specifically, a perpendicular is drawn to the abscissa from a minimum point which appears on the GPC curve when the retention time is about 17 min. The ratio which the area of a portion (high-molecular-weight component) on the high-molecular-weight side of the perpendicular accounts for in the whole area is calculated. Also, the ratio occupied by a low-molecular-weight component having a molecular weight of about 100,000 or less is obtained by calculating the ratio which the α and subsequent components account for in the whole area. More specifically, a perpendicular is drawn to the abscissa from a minimum point which appears on the GPC curve between the β and α component peaks when the retention time is about 23 min. The ratio which the area of a portion (low-molecular-weight component) on the low-molecular-weight side of the perpendicular accounts for in the whole area is calculated.

To achieve the effect of the present invention, it is particularly favorable that the high-molecular-weight component having a molecular weight of about 2,000,000 or more be 5% to 15%, and the low-molecular-weight component having a molecular weight of about 100,000 or less be 50% or less. If the high-molecular-weight component is too large, the filtering characteristics abruptly worsen. Also, if the low-molecular-weight component is too large and/or the high-molecular-weight component is too small, the effect of the present invention is not well achieved.

A general manufacturing method of gelatin is well known. For example, the method is described in T. H. James, The Theory of the Photographic Process, 4th ed., 1977, Macmillan, p. 55, Handbook of Scientific Photography (Book One), pp. 72 to 75 (Maruzen K. K.), Shin'ichi Kikuchi, Photographic Chemistry, 1976 (Kyoritsu Shuppan), p. 213, and Shiro Akahori & Saburo Mizushima ed., Protein Chemistry, 1955 (Kyoritsu Shuppan), p. 453.

For example, alkali-processed gelatin is manufactured by removing calcium from bones and skins as materials, processing and immersing the materials with lime to decompose the collagen structure, extracting with hot water, and thickening and drying the resultant material. Generally, the extraction is performed in stages numbered 1 to 7, and the extraction temperature is raised with the extraction number.

Manufacturing methods of the gelatin of the present invention are roughly classified into the following two methods.

1. Methods in Which Gelatin is Not Crosslinked For Example, the Following Methods are Used.

Manufacturing method (i) In the extracting operation of the above manufacturing method, a gelatin extract in the extraction late stage is used, and a gelatin extract in the extraction initial stage is excluded.

Manufacturing method (ii) In the above manufacturing method, the processing temperature is less than 40° C. in the manufacturing steps from extraction to drying.

Manufacturing method (iii) A gelatin gel is dialyzed with cold water (15° C.). Refer to The Journal of Photographic Science, Vol. 23, p. 33 (1975)].

Manufacturing method (iv) A differential method using isopropyl alcohol. Refer to Discussions of the Faraday Society, Vol. 18, p. 288 (1954).

The gelatin of the present invention can be obtained by using the above manufacturing methods singly or in combination.

2. Methods Using Gelatin Crosslinking Agent

Gelatin used in the present invention is more preferably crosslinked to control its molecular weight distribution. Crosslinking methods are a method of crosslinking gelatin molecules by enzyme, and a method of adding a crosslinking agent to form chemical bonds between gelatin molecules, thereby crosslinking the gelatin molecules.

As a representative method of the method using enzyme according to the present invention, gelatin crosslinked by transglutaminase will be described below. Transglutaminase enzyme can crosslink gelatin by a function of catalyzing an acyl transition reaction between a γ-carboxyamide group of a glutamine residue of gelatin as protein and various primary amines. The orinins of the transglutaminase includes animals, vegetables, and bacterias. Transglutaminase derived from animal is extracted from the liver of a mammal organ such as a guinea pig or from blood. Transglutaminase derived from vegetable is extracted from peas. Transglutaminase derived from bacteria is extracted from ray fungus. In the present invention, transglutaminase originated from anything can be preferably used provided that the transglutaminase shows transglutaminase activity.

Transglutaminase used in the present invention can be favorably synthesized by any of a method of Clark et al. (Archives of Biochemistry and Biophysics, 79, 338 (1959)), a method of Connel et al. (J. Bilogical Chemistry, 246 (1971)), a method described in JP-A-4-207149, and a method described in JP-A-6-30770. An example of such transglutaminase is AKUTEBA (trade name: manufactured by Ajinomoto Co., Inc.) Transglutaminase activity used in the present invention can be measured by reacting benzyloxycarbonyl L glutaminylglycine and hydroxyamine and obtaining the amount of the produced hydroxamic acid. Transglutaminase activity found by this measurement to produce $1\times10^{-6}$ mol of hydroxamic acid per min is one unit. Transglutaminase used in the present invention is preferably added in an amount which produces $1\times10^{-6}$ mol or more of hydroxamic acid per g of gelatin, although this amount changes in accordance with gelatin used, thereby controlling the molecular weight distribution.

In the method which crosslinks gelatin by using a crosslinking agent, all crosslinking agents conventionally known as gelatin hardeners can be used. Representative compounds are as follows.

A. Inorganic Crosslinking Agents (Inorganic Film Hardeners)

Cationic chromium complexes; ligands of the complexes are a hydroxyl group, oxalic acid group, citric acid group, malonic acid group, lactate, tartrate, succinate, acetate, formate, sulfate, chloride, and nitrate.

Aluminum salt; particularly sulfate, potassium alum, and ammonium alum. These compounds crosslink carboxyl groups of gelatin.

B. Organic Crosslinking Agents (Organic Film Hardeners)

1. Aldehyde-based crosslinking agents; most frequently used is formaldehyde. Effective crosslinking can also be performed by dialdehyde. Examples are glyoxazale and succinaldehyde, and glutaraldehyde is particularly effective. Diglycolaldehyde, various aromatic dialdehydes, dialdehyde starch, and a dialdehyde derivative of vegetable gum can also be used in crosslinking of the present invention.

2. N-methylol compounds and other protected aldehyde crosslinking agents; N-methylol compounds obtained by condensation between formaldehyde and various aliphatic straight-chain or cyclic amides, urea, and a nitrogen-containing heterocyclic ring. Practical examples are 2,3-dihydroxyoxane, acetic esters of dialdehyde and its hemiacetal, and 2,5-methoxytetrahydrofuran.

3. Ketone crosslinking agents; Compounds of diketones and quinones. Well-known diketones are 2,3-butandione and $CH_3COCOCH_3$. Well-known quinone is p-benzoquinone.

4. Sulfate ester and sulfonyl halides; Representative compounds are bis(sulfonylchlorides) and bis(sulfonylfluorides).

5. Active halogen compounds; Compounds having two or more active halogen atoms. Representative compounds are simple bis-α-chloro or bis-α-bromo derivatives of ketone, ester, and amide, bis(2-chloroethylurea), bis(2-chloroethyl) sulfone, and phosphoramidic halide.

6. Epoxide; A representative compound is butadiene dioxide.

7. Active olefin; Many compounds having two or more double bonds, particularly a nonsubstituted vinyl group activated by an adjacent electron attracting group are effective as crosslinking agents. Examples of the compounds are divinylketone, resorcinol bis(vinylsulfonate), 4,6-bis(vinylsulfonate), 4,6-bis(vinylsulfonyl)-m-xylene, bis(vinylsulfonylalkyl)ether or amine, 1,3,5-triacryloylhexahydro-s-triazine, diacrylamide, and 1,3-bis(acryloyl)urea.

8. s-Triazine-based compounds; Compounds represented by formula (H-1) below.

(H-I)

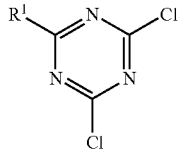

In this formula, $R^1$ represents a hydroxyl group, —OM group (M is a monovalent metal atom), 1- to 10-carbon alkyl group (e.g., methyl, ethyl, or 2-ethylhexyl), —$N(R^2)(R^3)$ group ($R^2$ and $R^3$ represent a 1- to 10-carbon alkyl group or 6- to 15-carbon aryl group and can be the same or different), —$NHCOR^4$ ($R^4$ represents a hydrogen atom, 1- to 20-carbon alkyl group, 6- to 20-carbon aryl group, 1- to 20-carbon alkylthio group, or 6- to 20-carbon arylthio group), or 1- to 20-carbon alkoxy group. Details of cyanuric chloride-based film hardeners represented by formula (H-I) above are described in Jpn. Pat. Appln. KOKOKU Publication No. (hereinafter referred to as JP-B-)47-6151, JP-B's-47-33380 and 54-25411, and JP-A-56-130740, the disclosures of which are incorporated herein by reference. Compounds having structures similar to a compound of formula (H-I), described in JP-B-53-2726 and JP-A's-50-61219 and 56-27135, the disclosure of which is incorporated herein by reference, are also useful in the present invention.

9. Vinylsulfone-based compounds; Compounds represented by formula (H-II) below.

$$X^1—SO_2—L—SO_2—X^2 \quad \text{(H-II)}$$

In this formula, $X^1$ and $X^2$ represent —CH═$CH_2$ or —$CH_2CH_2Y$ and can be the same or different. Y represents a group (e.g., a halogen atom, sulfonyloxy, or sulfuric monoester) which is substituted by a nucleophilic group or can split off in the form of HY by a base. L represents a divalent linking group which can be substituted. Details of vinylsulfone-based film hardeners represented by formula (H-II) are described in, e.g., JP-B's-47-24259 and 50-35807, and JP-A's-49-24435, 53-41221, and 59-18944, the disclosures of which are incorporated herein by reference.

10. Carbamoylammonium salt; Compounds represented by formula (H-III) below.

(H-III)

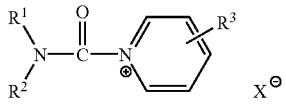

In this formula, $R^1$ and $R^2$ represent a 1- to 10-carbon alkyl group (e.g., methyl, ethyl, or 2-ethylhexyl), 6- to 15-carbon aryl group (e.g., phenyl or naphthyl), or 7- to 15-carbon aralkyl group (e.g., benzyl or phenethyl), and can be the same or different. $R^1$ and $R^2$ can also favorably combine to form a heterocyclic ring together with the nitrogen atom. $R^3$ represents a hydrogen atom, substituted or nonsubstituted, 1- to 10-carbon alkyl group (e.g., methyl or 2-sulfoethyl), 6- to 15-carbon aryl group (e.g., phenyl), 7- to 15-carbon aralkyl group (e.g., benzyl), or carbamoyl group. $X^-$ represents an anion. Details of carbamoylammonium salt-based film hardeners represented by formula (H-III) are described in JP-B's-56-12853 and 58-32699, and JP-A's-49-51945, 51-59625, and 61-9641, the disclosures of which are incorporated herein by reference.

11. Compounds represented by formula (H-IV) below.

(H-IV)

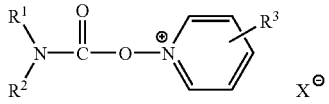

In this formula, $R^1$, $R^2$, $R^3$, and $X^-$ have exactly the same definitions as in formula (H-III). These compounds are described in detail in Belgian Patent No. 825,726, the disclosure of which is incorporated herein by reference.

12. Amidinium salt-based compounds; Compounds represented by formula (H-V) below.

(H-V)

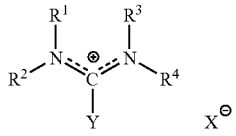

In this formula, $R^1$, $R^2$, $R^3$, and $R^4$ represent a 1- to 20-carbon alkyl group, 7- to 20-carbon aralkyl group, or 6- to 20-carbon aryl group, and can be the same or different. Y represents a group which can split off when a compound represented by formula (H-V) reacts with a nucleophilic reagent. Preferred examples are a halogen atom, sulfonyloxy group, and 1-pyridiniumyl group. $X^-$ represents an anion. Details of amidinium salt-based film hardeners represented by formula (H-V) are described in JP-A-60-225148, the disclosure of which is incorporated herein by reference.

13. Carbodiimide-based compounds; Compounds represented by formula (H-VI) below.

$$R^1—N═C═N—R^2 \quad \text{(H-VI)}$$

In this formula, $R^1$ represents a 1- to 10-carbon alkyl group (e.g., a methyl group or ethyl group), 5- to 8-carbon cycloalkyl group, 3- to 10-carbon alkoxyalkyl group, or 7- to 15-carbon aralkyl group. $R^2$ represents a group defined by $R^1$. These carbodiimide-based film hardeners are described in detail in JP-A's-51-126125 and 52-48311, the disclosures of which are incorporated herein by reference.

14. Pyridinium base compounds; Compounds represented by formula (H-VII) below.

(H-VII)

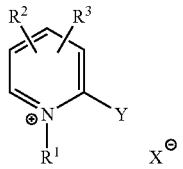

In this formula, $R^1$ represents a 1- to 10-carbon alkyl group, 6- to 15-carbon aryl group, or 7- to 15-carbon aralkyl group, and these groups can be substituted. $R^2$ and $R^3$ represent a hydrogen atom, or a substituent such as halogen atom, acylamide group, nitro group, carbamoyl group, ureido group, alkoxy group, alkyl group, alkenyl group, aryl group, or aralkyl group, and can be the same or different. $R^2$ and $R^3$ can also favorably combine to form a condensed ring together with the pyridinium ring skeleton. Y represents a group which can split off when a compound represented by formula (H-VII) reacts with a nucleophilic reagent. $X^-$ represents an anion. These pyridinium base film hardeners are described in detail in JP-B-58-50699 and JP-A's-57-44140 and 57-46538, the disclosures of which are incorporated herein by reference.

15. Pyridinium salt-based compounds; Compounds represented by formula (H-VIII) below.

(H-VIII)

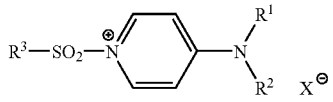

In this formula, $R^1$ and $R^2$ have exactly the same definitions as $R^1$ and $R^2$ in formula (H-III). $R^3$ represents a 1- to 10-carbon alkyl group, 6- to 15-carbon aryl group, or 7- to 15-carbon aralkyl group. $X^-$ represents an anion. Details of pyridinium salt-based film hardeners represented by formula (H-VIII) are described in JP-A-52-54427, the disclosure of which is incorporated herein by reference.

In addition to the compounds represented by formulas (H-I) to (H-VIII) described above, compounds described in JP-A's-50-38540, 52-93470, 56-43353, and 58-113929, and U.S. Pat. No. 3,321,313, the disclosures of which are incorporated herein by reference, are also favorable as film hardeners used in the present invention.

Practical examples of compounds used in the present invention are classified below. However, the present invention is not limited to these examples.

(H-I-1)

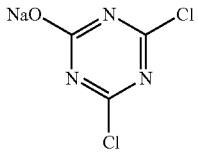

(H-I-2)

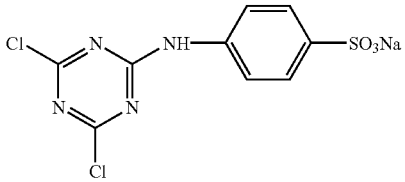

(H-II-1)

$CH_2{=}CHSO_2CH_2SO_2CH{=}CH_2$ (H-II-2)

$CH_2{=}CHSO_2CH_2OCH_2SO_2CH{=}CH_2$ (H-II-3)

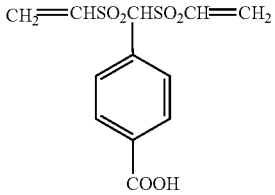

(H-II-4)

$CH_2{=}CHSO_2CH_2CONH{-}(CH_2)_2{-}NHCOCH_2SO_2CH{=}CH_2$ (H-II-5)

$CH_2{=}CHSO_2CH_2CONH{-}(CH_2)_3{-}NHCOCH_2SO_2CH{=}CH_2$ (H-III-1)

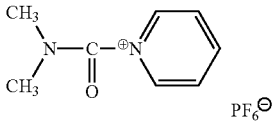

(H-III-2)

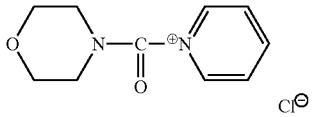

(H-III-3)

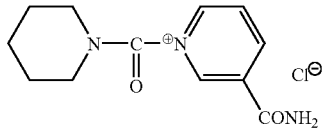

(H-III-4)

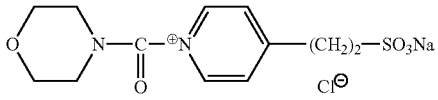

(H-IV-1)

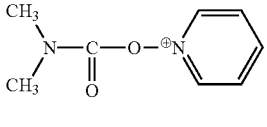

(H-IV-2)

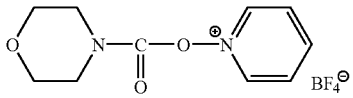

-continued (H-V-1)

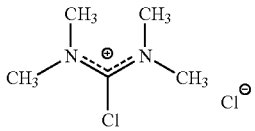

(H-VI-1)

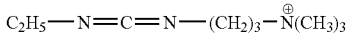

(H-VI-2)

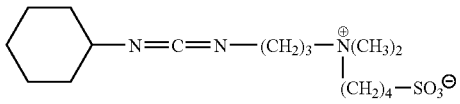

(H-VI-3)

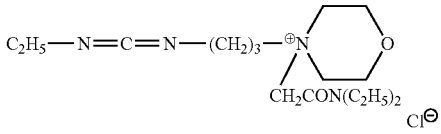

(H-VII-1)

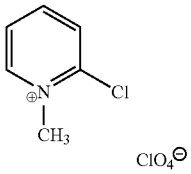

(H-VII-2)

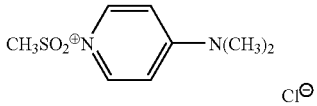

In the manufacture of the gelatin used in an emulsion of the present invention, any crosslinking agent described above is added to a gelatin solution to cause inter-gelatin molecule crosslinking. The crosslinking conditions vary in accordance with the type of crosslinking agent. However, the reaction conditions can be determined by setting a predetermined reaction temperature and reaction time and measuring the molecular weight distribution of gelatin by GPC. In this measurement, the progress of crosslinking can be tracked by measuring the viscosity of the gelatin solution. The added crosslinking agent is desirably allowed to entirely react. However, if the crosslinking agent remains without reacting, this remaining crosslinking agent can be removed by ultrafiltration of the gelatin solution after the crosslinking reaction. The molecular weight distribution of gelatin of the present invention can be controlled by adjusting the addition amount of a crosslinking agent and the crosslinking reaction conditions such as the temperature, time, and pH of the crosslinking reaction. In the present invention, it is favorable to use gelatin crosslinked by any one of the above-mentioned crosslinking agents or by combining two or more types of these crosslinking agents. It is preferable to use gelatin crosslinked using an s-triazine-based compound represented by formula (H-I), a vinylsulfone-based compound represented by formula (H-II), carbamoylammonium salt represented by formula (H-III), or a carbodiimide-based compound represented by formula (H-VI). A vinylsulfone-based compound represented by formula (H-II) is particularly preferred in that the influence on photographic properties is little.

As original gelatin for use in the manufacture of gelatin of the present invention, either alkali-processed gelatin or acid-processed gelatin can be used. However, alkali-processed gelatin is more preferred because the impurity content having adverse effect on photographic properties is small. In particular, the use of alkali-processed gelatin subjected to deionization or ultrafiltration by which impurity ions or impurities are removed. Alkali-processed gelatin is also favored as original gelatin of crosslinked gelatin which is preferably used in the present invention.

U.S. Pat. No. 5,318,889 discloses gelatin whose molecular weight is increased by crosslinking acid-processed gelatin by a vinylsulfone compound. The gelatin disclosed in this patent does not reach the molecular weight distribution of gelatin of the present invention. However, it is found that when the high-molecular-weight component of acid-processed gelatin is increased to be equal to that of gelatin of the present invention, the acid-processed gelatin deteriorates the photographic properties, e.g., lowers the photographic sensitivity.

The gelatin of the present invention can also be subjected to various modification processes. Examples are phthalated gelatin having a modified amino group, succinated gelatin, trimellitic gelatin, pyromellitic gelatin, esterified gelatin having a modified carboxyl group, amidized gelatin, formylated gelatin having a modified imidazole group, oxidized gelatin having a reduced methionine group, and reduced gelatin having an increased methionine group.

Also, use can be made of other hydrophilic colloids.

For example, use can be made of a variety of synthetic hydrophilic polymeric materials including proteins such as gelatin derivatives, graft polymers from gelatin/other polymers, albumin and casein; sugar derivatives, for example, cellulose derivatives such as hydroxyethylcellulose, carboxymethylcellulose and cellulose sulfate, sodium alginate and starch derivatives; and homo- or copolymers such as polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole. Suitable gelatins include, for example, not only lime treated gelatins but also acid treated gelatins and, further, enzyme treated gelatins as described in Bull. Soc. Sci. Photo. Japan, No. 16, p.30 (1966). Also, use can be made of gelatin hydrolyzates and enzymolyzates.

The pH, pAg, type and concentration of gelatin and viscosity are selected for the preparation of the epitaxial tabular grains of the present invention. In particular, the pH is important, and is preferably 4 to 5.5. More preferably, it is in the range of 4.5 to 5. The epitaxial deposition would occur uniformly among the grains, by which the advantages of the present invention become remarkable.

A sensitizing dye is used as a site-directing agent (or site director) for the epitaxial junction. The position of epitaxial deposition can be controlled by selecting the amount and type of employed sensitizing dye. Dyes are each preferably added in an amount of 50 to 90% based on a saturated coating quantity. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes. Any of nuclei commonly used in cyanine dyes as basic heterocyclic nuclei can be employed in these dyes. That is, there can be employed, for example, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzoindolenine nucleus, an indole nucleus, a benzoxazole nucleus, a naphthoxazole nucleus, a benzothiazole nucleus, a naphthothiazole nucleus, a benzoselenazole nucleus, a benzoimidazole nucleus and a quinoline nucleus. These nuclei may have substituents on carbon atoms thereof.

These sensitizing dyes may be used either individually or in combination. The sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB Nos. 1,344,281 and 1,507,803, JP-B's-43-4936 and 53-12375, and JP-A's-52-110618 and 52-109925.

The emulsion of the present invention may be loaded with a dye which itself exerts no spectral sensitizing effect or a substance which absorbs substantially none of visible light and exhibits supersensitization, simultaneously with or separately from the above sensitizing dye.

Increased silver iodide content in the extreme surface composition of host tabular grains at the time of adsorption of sensitizing dye is preferred from the viewpoint of preparation of epitaxial tabular grains. Thus, addition of iodide ions is effected prior to the incorporation of sensitizing dye. In the present invention, it is most preferably employed to add the aforementioned AgI fine grain emulsion to thereby increase the silver iodide content of the surface of host tabular grains. This renders the intergranular distribution of silver iodide content uniform and renders the adsorption of sensitizing dye uniform. As a result, the preparation of epitaxial tabular grains can be realized. The addition amount of such iodide ions or silver iodide is preferably in the range of $1\times10^{-4}$ to $1\times10^{-2}$ mol, more preferably $1\times10^{-3}$ to $5\times10^{-3}$ mol, per mol of host tabular grains.

With respect to the method of forming epitaxial portions, a solution containing halide ions and a solution containing $AgNO_3$ may be added simultaneously or separately. Alternatively, the formation may be effected by carrying out the addition in appropriate combination with, for example, the addition of AgCl fine grains, AgBr fine grains or AgI fine grains all having a grain diameter smaller than that of host tabular grains, or the addition of mixed crystal grains thereof. In the addition of the $AgNO_3$ solution, the addition time is preferably in the range of 30 sec to 10 min, more preferably 1 to 5 min. For the formation of the epitaxial tabular grains of the present invention, the concentration of added silver nitrate solution is preferably 1.5 mol/L or less, more preferably 0.5 mol/L or less. At that time, the agitation of the system must be carried out efficiently, and, with respect to the viscosity of the system, the lower, the more preferable.

The silver quantity of epitaxial portions is preferably in the range of 1 to 10 mol %, more preferably 2 to 7 mol %, based on the silver quantity of host tabular grains. When the silver quantity is too small, the epitaxial tabular grains cannot be prepared. On the other hand, when the silver quantity is too large, the resultant epitaxial tabular grains are unstable.

At the formation of epitaxial portions, the pBr is preferably 3.5 or more, more preferably 4.0 or more. The temperature is preferably in the range of 35 to 45° C. At the formation of epitaxial portions, it is preferred that the emulsion be doped with a 6-cyano metal complex.

Among the 6-cyano metal complex, those containing iron, ruthenium, osmium, cobalt, rhodium, iridium or chromium are preferable. The addition amount of the metal complex is preferably within the range of $10^{-9}$ to $10^{-2}$ per mol of the total silver halide of the epitaxial portion and the host portion, and more preferably within the range of $10^{-8}$ to $10^{-4}$ mol. The metal complex may be added by dissolving it to water or a organic solvent. The organic solvent is preferably miscible with water. As examples of the organic solvent, alcohols, ethers, glycols, ketons, esters, and amides are included.

As the metal complexes, 6-cyanometal complexes represented by the following formula (I) is especially preferable. The 6-cyano metal complex has advantages of attaining high-sensitive lightsensitive material, and suppressing fogging from arising even when a raw photosensitive material is stored for a long period of time.

$$[M(CN)_6]^{n-} \quad (I)$$

wherein M represents iron, ruthenium, osmium, cobalt, rhodium, iridium or chromium, and n represent 3 or 4.

Specific examples of the 6-cyano metal complexes are set forth below:

| | |
|---|---|
| (I-1) | $[Fe(CN)_6]^{4-}$ |
| (I-2) | $[Fe(CN)_6]^{3-}$ |
| (I-3) | $[Ru(CN)_6]^{4-}$ |
| (I-4) | $[Os(CN)_6]^{4-}$ |
| (I-5) | $[Co(CN)_6]^{3-}$ |
| (I-6) | $[Rh(CN)_6]^{3-}$ |
| (I-7) | $[Ir(CN)_6]^{3-}$ |
| (I-8) | $[Cr(CN)_6]^{4-}$ |

For the counter cations of the 6-cyano complex, those easily miscible with water, and suitable for precipitation procedure of a silver halide emulsion are preferably used. Examples of the counter ions includes alkali metal ions (e.g. sodium ion, potassium ion, rubidium ion, cesium ion and lithium ion), ammonium ion and alkylammonium ion.

Into the emulsion of the present invention, the aforementioned sensitizing dyes and/or anti-foggants to be described later and/or stabilizers are preferably added. In the present invention, it is preferable to decrease pBr after this. In epitaxial emulsions outside the scope of the invention destruction of epitaxial occurs by this pBr decrease, which results in a photographic material whose properties of speed is low. On the other hand, in the epitaxial emulsion of the present invention, this pBr decrease can be realized, thereby advantages in storagebility and processability can be attained remarkably. Preferably, the pBr is lowered to 3.5 or less at 40° C., more preferably, the pBr is 3.0 or less at 40° C. Especially preferably, the pBr is 2.5 or less. Decreasing pBr is basically performed by adding bromide ions, for example, KBr and NaBr.

After the epitaxial deposition, washing is usually performed. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

Chemical sensitization is preferably performed after epitaxial deposition of the emulsion of the invention. One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid and the modifier are described in U.S. Pat. Nos. 2,131,038, 3,411,914, and 3,554,757, JP-A-58-126526, and G.F. Duffin, Photographic Emulsion Chemistry, pages 138 to 143.

It is preferable to also perform gold sensitization for emulsions of the present invention. An amount of a gold sensitizer is preferably 1 x to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

In the tellurium sensitization, labile tellurium compounds, such as hose described in JP-A's-4-22459, 4-271341, 4-333043, 5-303157, 6-27573, 6-175258, 6-180478, 6-208184, 6-208186, 6-317867, 7-140579, 7-301879, and 7-301880, may be used.

More specifically, phosphinetellurides (e.g., n-butyl-diisopropylphosphinetelluride, triisobutylphosphinetelluride, tri-n-butoxyphosphinetelluride, triisopropylphosphinetelluride), diacyl(di)telluride (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride), telluroureas (e.g., N,N'-dimethylethylenetellurourea), telluroamides, telluroesters may be used. Preferably, phosphynetellurides and diacyltellurides may be used.

Photographic emulsions used in the present invention can contain various compounds in order to prevent fog during the preparing process, storage, or photographic processing of a sensitized material, or to stabilize photographic properties. That is, it is possible to add many compounds known as antifoggants or stabilizers, e.g., thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxazolinethione; and azaindenes such as triazaindenes, tetrazaindenes (particularly 4-hydroxy-substituted(1,3,3a,7)tetrazaindenes), and pentazaindenes. For example, compounds described in U.S. Pat. Nos. 3,954,474 and 3,982,947 and JP-B-52-28660 can be used. One preferred compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

In the preparation of the emulsion of the present invention, it is preferable to make salt of metal ion exist, for example, during grain formation, during eptiaxial formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core, the shell, or the epitaxial portion of a grain, and only a substrate grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as water, methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

Reduction sensitization is preferably performed during grain formation, after grain formation and before chemical sensitization, during chemical sensitization, or after chemical sensitization of the emulsion of the present invention.

Reduction sensitization preferable performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods. The method of adding reduction sensitizers is preferred in that the level of reduction sensitization can be finely adjusted.

As examples of the reduction sensitizer stannous chloride, ascorbic acid and its derivatives, amines and polyamines, hydrazine and its derivatives, formamidinesulfinic acid, a silane compound, and a borane compound, can be mentioned. In reduction sensitization of the present invention, it is possible to selectively use these reduction sensitizers or to use two or more types of compounds together. Preferable reduction sensitizers are stannous chloride, thioure dioxide, dimethylaminborane, ascorbic acid and its derivatives are preferable compounds. Although the addition amount of reduction sensitizers must be so selected as to meet the emulsion manufacturing conditions, a proper amount is $10^{-7}$ to $10^{-3}$ mol per mol of a silver halide.

The reduction sensitizer is added during grain formation by dissolving thereof to water, or organic solvents such as alcohols, glycols, ketones, esters, and amides. The reduction sensitizer may be previously added to a reaction vessel, but a method of adding it at a proper time during grain growth is preferable. It is also possible to add a reduction sensitizer previously into an aqueous solution of a water-soluble silver salt or a water-soluble alkali halide, and precipitating silver halide grains by using the aqueous solution. A method of adding a solution of a reduction sensitizer separately in several times or a method of continuously adding it for a long time is also preferable.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2 \cdot H_2O_2 \cdot 3H_2O$, $2NaCO_3 \cdot 3H_2O_2$, $Na_4P_2O_7 \cdot 2H_2O_2$ and $2Na_2SO_4 \cdot H_2O_2 \cdot 2H_2O$), peroxy acid salts (e.g., $K_2S_2O_8$ $K_2C_2O_6$ and $K_2P_2O_8$), peroxy complex compounds (e.g., $K_2[Ti(O_2)C_2O_4] \cdot 3H_2O$, $4K_2SO_4 \cdot Ti(O_2)OH.SO_4 \cdot 2H_2O$ and $Na_3[VO(O_2)(C_2H_4)_2] \cdot 6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones. Using the aforementioned reduction sensitizer in combination with the oxidizer to silver is a preferable embodiment. A method can be selected from that of performing the reduction sensitization after using the oxidizer, a reverse method thereof, or a method of letting both compounds co-exist.

The silver halide color photographic material that is prepared by using the silver halide photographic emulsion of the present invention should have at least one lightsensitive layer. Preferably, the photographic material is provided with at least one blue-sensitive emulsion layer, at least one green-sensitive emulsion layer, and at least one red-sensitive layer on a support, and at least one of blue-, green- and red-sensitive layers is composed of two or more layers having different speeds to each other. As long as the photographic material meets the requirements, the numbers of a silver halide emulsion layer and a non light-sensitive emulsion layer, and the arrangement order thereof are not particularly limited. A typical example of the photographic material is the one having at least one color-sensitive layer composed of a plurality of silver halide emulsion layers having substantially the same color sensitivity but different in speed, on a support. The color-sensitive layer is a unit lightsensitive layer having color-sensitivity of any one of glue light, green light and red light. In a multi-layered silver halide color photographic light sensitive material, the unit color sensitive layer is generally arranged in the order of red color-sensitive layer, green color-sensitive layer and blue color-sensitive layer from the support. However, the arrangement order may be reversed depending on the purpose thereof. Also, an arrangement order in which a different color-sensitive layer is interposed between color-sensitive layers having the same color-sensitivity, is also possible.

A non lightsensitive layer such as an inter layer may be provided with between the silver halide lightsensitive layers and in the uppermost and lowermost layers. In the inter layer, DIR compounds and couplers such as described in JP-A-61-43748, 59-113438, 59-113440, 61-20037, and 61-20038, and a color-mixing inhibitor may be contained as usually do so.

A two-layer structure of high- and low-speed emulsion layers can be preferably used for a plurality of silver halide emulsion layers constituting each unit lightsensitive layer, as described in DE (German Patent) 1,121,470 or GB 923,045, the disclosures of which are incorporated herein by reference. Usually, the layers are preferably arranged such that the speed thereof decreases sequentially toward the support. A non lightsensitive layer may also be interposed between each silver halide emulsion layer. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of blue-sensitive layer/GH/RH/GL/RL.

Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

Even when the number of layers is four or more, the order of these layers can be changed as described above.

A layer in which an emulsion of the present invention is used is preferably a low-speed emulsion layer. This low-speed emulsion layer can be any of a red-sensitive, low-speed emulsion layer, green-sensitive, low-speed emulsion layer, and blue-sensitive, low-speed emulsion layer, and a red-sensitive, low-speed emulsion layer is favored. More preferably, a silver halide emulsion having no epitaxial junction is contained in a high-speed emulsion layer, the emulsion of the present invention is used in a low-speed layer. As a silver halide emulsion having no epitaxial junction, it is possible to preferably use tabular-grain emulsions containing dislocation lines in fringe portions, described in, e.g., JP-A's-11-174606 and 11-295832, the disclosures of which are incorporated herein by reference. This method of use can improve the performance of a light-sensitive material and can also reduce the silver coating amount. The silver amount (the weight in units of silver atoms) of an emulsion used in each emulsion layer is preferably 0.3 to 3 g/m$^2$, and more preferably, 0.5 to 2 g/m$^2$.

As described above, various layer arrangements and orders can be selected in accordance with the purpose of a light-sensitive material.

The diverse additives described above are used in a light-sensitive material according to the present invention. In addition, various other additives can be used in accordance with the intended use.

The additives are described in detail in Research Disclosure Item 17643 (December 1978), Item 18716 (November 1979) and Item 308119 (December 1989), the disclosures of which are incorporated herein by reference. A summary of the locations where they are described will be listed in the following table.

| Types of additives | RD17643 | RD18716 | RD308119 |
|---|---|---|---|
| 1 Chemical sensitizers | page 23 | page 648 right column | page 996 |
| 2 Sensitivity-increasing agents | | page 648 right column | |
| 3 Spectral sensitizers, super-sensitizers | pages 23-24 | page 648, right column to page 649, right column | page 996, right column to page 998, right column |
| 4 Brighteners | page 24 | | page 998 right column |
| 5 Antifoggants, stabilizers | pages 24-25 | page 649 right column | page 998, right column to page 1000, right column |
| 6 Light absorbents, filter dyes, ultraviolet absorbents | pages 25-26 | page 649, right column to page 650, left column | page 1003, left column to page 1003, right column |
| 7 Stain preventing agents | page 25, right column | page 650, left to right columns | page 1002, right column |
| 8 Dye image stabilizers | page 25 | | page 1002, right column |
| 9 Film hardeners | page 26 | page 651, left column | page 1004, right column page 1005, left column |
| 10 Binders | page 26 | page 651, left column | page 1003, right column to page 1004, right column |
| 11 Plasticizers, lubricants | page 27 | page 650, right column | page 1006, left to right columns |
| 12 Coating aids, surfactants | pages 26-27 | page 650, right column | page 1005, left column to page 1006, left column |
| 13 Antistatic agents | page 27 | page 650, right column | page 1006, right column to page 1007, left column |
| 14 Matting agents | | | page 1008, left column to page 1009, left column. |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

Various color couples may be used in the present invention, and the specific examples thereof are described in the patents described in the patents described in the aforementioned Research Disclosure No. 17643, VII-C to G and No. 307105, VII-C to G.

Preferred yellow couplers are those described in, for example, U.S. Pat. Nos. 3,933,051, 4,022,620, 4,326,024, 4,401,752 and 4,248,961, JP-B-58-10739, British Patent Nos. 1,425,020 and 1,476,760, U.S. Pat. Nos. 3,973,968, 4,314,023 and 4,511,649, and European Patent No. 249, 473A.

Particularly preferred magenta couplers are 5-pyrazolone and pyrazoloazole compounds. Particularly preferred are those described in U.S. Pat. Nos. 4,310,619 and 4,351,897, European Patent No. 73,636, U.S. Pat. Nos. 3,061,432 and 3,725,067, Research Disclosure No. 24220 (June, 1984), JP-A-60-33552, Research Disclosure No. 24230 (June, 1984), JP-A's-60-43659, 61-72238, 60-35730, 55-118034 and 60-185951, U.S. Pat. Nos. 4,500,630, 4,540,654 and 4,556,630, and International Publication No. WO 88/04795.

The cyan couplers usable in the present invention are phenolic and naphtholic couplers. Particularly preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Unexamined Published Application No. 3,329,729, European Patent Nos. 121,365A and 249, 453A, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized color-forming couplers are described in, for example, U.S. Pat. Nos. 3,451, 820, 4,080,211, 4,367,282, 4,409,320 and 4,576,910, British Patent No. 2,102,137 and European Patent No. 341,188A.

The couplers capable of forming a colored dye having a suitable diffusibility are preferably those described in U.S. Pat. No. 4,366,237, British Patent No. 2,125,570, European Patent No. 96,570 and West German Patent (Publication) No. 3,234,533.

Colored couplers used for compensation for unnecessary absorption of the colored dye are preferably those described in Research Disclosure No. 17643, VII-G and No. 307105, VII-G, U.S. Pat. No. 4,163,670, JP-B-57-39413, U.S. Pat. Nos. 4,004,929 and 4,138,258 and British Patent No. 1,146, 368. Other couplers preferably used herein include couplers capable of compensating for an unnecessary absorption of the colored dye with a fluorescent dye released during the coupling as described in U.S. Pat. No. 4,774,181 and couplers having, as a removable group, a dye precursor group capable of forming a dye by reacting with a developing agent as described in U.S. Pat. No. 4,777,120.

Further, compounds which release a photo-graphically useful residue during a coupling reaction are also preferably usable in the present invention. DIR couplers which release a development inhibitor are preferably those described in the patents shown in the above described RD 17643, VII-F and No. 307105, VII-F as well as those descried in JP-A's-57-151944, 57-154234, 60-184248, 63-37346 and 63-37350 and U.S. Pat. Nos. 4,248,962 and 4,782,012.

The couplers which release a nucleating agent or a development accelerator in the image-form in the development step are preferably those described in British Patent Nos. 2,097,140 and 2,131,188 and JP-A's-59-157638 and 59-170840. Further, compounds capable of releasing a fogging agent, development accelerator, solvent for silver halides, etc. upon the oxidation-reduction reaction with an oxidate of a developing agent as described in JP-A's-60-107029, 60-252340, 1-44940 and 1-45687 are also preferred.

Other compounds usable for the photosensitive material according to the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A's-60-185950 and 62-24252, couplers which release a dye that restores the color after coupling-off as described in European Patent Nos. 173,302 A and 313,308 A, ligand-releasing couplers described in U.S. Pat. No. 4,555,477, leuco dye-releasing couplers described in JP-A-63-75747 and fluorescent dye-releasing couplers described in U.S. Pat. No. 4,774,181.

The couplers used in the present invention can be incorporated into the photosensitive material by various known dispersion methods.

High-boiling solvents used for an oil-in-water dispersion method are described in, for example, U.S. Pat. No. 2,322, 027. The high-boiling organic solvents having a boiling point under atmospheric pressure of at least 175° C. and usable in the oil-in-water dispersion method include, for example, phthalates (such as dibutyl phthalate, dicyclohexyl phthalate, di-2-ethylhexyl phthalate, decylphthalate, bis(2, 4-di-t-amylphenyl) phthalate, bis(2,4-di-t-amylphenyl) isophthalate and bis(1,1-diethylpropyl)phthalate), phosphates and phosphonates (such as triphenyl phosphate, tricresyl phosphate, 2-ethylhexyldihenyl phosphate, tricyclohexyl phosphate, tri-2-ethylhexyl phosphate, tridodecyl phoshate, tributoxyethyl phosphate, trichloropropyl phosphate and di-2-ethylhexylphenyl phosphate), benzoates (such as 2-ethylhexyl benzoate, dodecyl benzoate and 2-ethylhexyl-p-hydroxybenzoate), amides (such as N,N-di ethyldodecaneamide, N,N-diethyllaurylamide and N-tetradecylpyrrolidone), alcohols and phenols (such as isostearyl alcohol and 2,4-di-tert-amylphenol), aliphatic carboxylates (such as bis(2-ethylhexyl) sebacate, dioctyl azelate, glycerol tributyrate, isostearyl lactate and trioctyl citrate), aniline derivatives [such as N,N-dibutyl-2-butoxy-5-tert-octylaniline] and hydrocarbons (such as paraffin, dodecylbenzene and diisopropylnaphthalene).

Co-solvents usable in the present invention include, for example, organic solvents having a boiling point of at least about 30° C., preferably 50 to about 160° C. Typical examples of them include ethyl acetate, butyl acetate, ethyl propionate, methyl ethyl ketone, cyclohexanone, 2-ethoxyethyl acetate and dimethylformamide.

The steps and effects of the latex dispersion method and examples of the latices usable for the impregnation are described in, for example, U.S. Pat. No. 4,199,363 and West German Patent Application (OLS) Nos. 2,541,274 and 2,541,230.

The color photosensitive material used in the present invention preferably contains phenethyl alcohol or an antiseptic or mold-proofing agent described in JP-A's-63-257747, 62-272248 and 1-80941 such as 1,2-benzoisothiazolin-3-one, n-butyl p-hydroxybenzoate, phenol, 4-chloro-3,5-dimethylphenol, 2-phenoxyethanol or 2-(4-thiazolyl) benzimidazole.

The present invention is applicable to various color photosensitive materials such as ordinary color negative films, cinema color negative films, reversal color films for slides or televisions, color papers, positive color films and reversal color papers.

Suitable supports usable in the present invention are described, for example, on page 28 of the above-described RD. No. 17643, from right column, page 647 to left column, page 648 of RD. No. 18716 and on page 879 of RD. No. 307105.

The photosensitive material of the present invention has a total thickness of the hydrophilic colloidal layers on the emulsion layer-side of 28 μm or below, preferably 23 μm or below, more preferably 18 μm or below and particularly 16 μm or below. The film-swelling rate $T_{1/2}$ is preferably 30 sec or below, more preferably 20 sec or below. The thickness is determined at 25° C. and at a relative humidity of 55% (2 days). The film-swelling rate $T_{1/2}$ can be determined by a method known in this technical field. For example, it can be determined with a swellometer described on pages 124 to 129 of A. Green et al., "Photogr. Sci. Eng.", Vol. 19, No. 2. $T_{1/2}$ is defined to be the time required for attaining the thickness of a half (½) of the saturated film thickness (the saturated film thickness being 90% of the maximum thickness of the film swollen with the color developer at 30° C. for 3 minute 15 seconds).

The film-swelling rate $T_{1/2}$ can be controlled by adding a hardener to gelatin used as the binder or by varying the time conditions after the coating.

The photosensitive material used in the present invention preferably has a hydrophilic colloid layer (in other words, back layer) having total thickness of 2 to 20 μm on dry basis on the opposite side to the emulsion layer. The back layer preferably contains the above-described light absorber, filter dye, ultraviolet absorber, antistatic agent, hardener, binder, plasticizer, lubricant, coating aid, surfactant, etc. The swelling rate of the back layer is preferably 150 to 500%.

The color photographic lightsensitive material according to the present invention may be developed by a conventional method described in aforementioned RD. No. 17643, pages 28 to 29, ditto No. 18716, page 651, left to right columns, and ditto No. 30705, pages 880 to 881.

The color developer to be used in the development of the light-sensitive material of the present invention is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxy-ethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these compounds are 3-methyl-4-amino-N-ethyl-N-β-hydroxyethylaniline sulfate. These compounds can be used in combination of two or more thereof depending on the purpose of application.

The color developer normally contains a pH buffer such as carbonate, borate and phosphate of an alkali metal or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-bis-carboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof).

Further, when reversal processing is to be performed on the photographic material, color development is usually performed after black-and-white development. As the black-and-white developer, known black-and-white developers can be used singly or in combination, which include dihydroxybenzenes, such as hydroquinone, 3-pyrazolidones, such as 1-phenyl-3-pyrazolidone, or aminophenols, such as N-methyl-p-aminophenol. Theses black-and-white developers usually have a pH of from 9 to 12. The replenishment rate of the developer is usually 3 liter (hereinafter liter is also referred to as "L") or less per $m^2$ of the lightsensitive material, though depending on the type of the color photographic material to be processed. The replenishment rate may be reduced to 500 milliliter/$m^2$ or less by decreasing the bromide ion concentration in the replenisher (hereinafter milliliter is also referred to as "mL"). If the replenishment rate is reduced, the area of the processing tank in contact with air is preferably reduced to inhibit the evaporation and air oxidation of the processing solution.

The area of the photographic processing solution in contact with air in the processing tank can be represented by an opening rate as defined by the following equation:

$$\text{Opening rate}=[\text{area of processing solution in contact with air } (cm^2)/[\text{volume of processing solution } (cm^3)]$$

The opening rate as defined above is preferably in the range of 0.1 or less, more preferably 0.001 to 0.05. Examples of methods for reducing the opening rate include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening rate is preferably effected in both color development and black-and-white development steps as well as all the subsequent steps such as bleach, blix, fixing, washing and stabilization. The replenishment rate can also be reduced by a means for suppressing accumulation of the bromide ion in the developing solution.

The period for the color development processing usually sets between 2 to 5 min, the processing time can be shortened further by setting high pH and temperature, and using high concentration color developer.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of potyvalent metals, e.g., iron (III), peroxides, quinones, and nitro compounds. Typical examples of these bleaching agents are organic complex salts of iron (III) with, e.g., aminopolycarboxylic acids such as ethylenediaminetetraacetic acid, diethylenetriaminepentaacetic acid, cyclohexanediaminetetraacetic acid, methyliminodiacetic acrid, 1,3-diaminopropanetetraacetic acid and glycol ether diaminetetraacetic acid, or citric acid, tartaric acid, malic acid, etc. Of these, aminopolycarboxylic acid-iron (III) complex salts such as ethylenediaminetetraacetato iron (III) complex salts and 1,3-diaminopropanetetraacetato iron (III) complex salts are preferred in view of speeding up of processing and conservation of the environment. In particular, aminopolycarboxylic acid-iron (III) complex salts are useful in both of a bleaching solution and a blix solution. The pH value of a bleaching solution or blix solution comprising such an antinopolycarboxylic acid-iron (III) complex salts is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patents 1,290,812 and 2,059,988, JP-A's-53-32736, 53-57831, 53-37418, 53-72623, 53-95630, 53-95631, 53-104232, 53-124424, 53-141623, and 53-28426 and Research Disclosure No. 17129 (July 1978), thiazolidine derivatives as described in JP-A-51-140129, thiourea derivatives as described in JP-B-45-8506, JP-A's-52-20832, and 53-32735 and U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A's-49-40943, 49-59644, 53-94927, 54-35727, 55-26506 and 58-163940, and bromine ions. Preferred among these compounds are compounds containing a mercapto group or disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the light-sensitive material. These bleaching accelerators are particularly effective for blix of color light-sensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc. are preferred.

Examples of fixing agents to be contained in the fixing solution or blix solution include thiosulfates, thiocyanates, thioethers, thioureas, and a large amount of iodides. The thiosulfites are normally used. In particular, ammonium thiosulfate can be most widely used. Further, thiosulfates are preferably used in combination with thiocyanates, thioether compounds, thioureas, etc. As preservatives of the fixing or blix bath there can be preferably used sulfites, bisulfites, carbonyl bisulfite adducts or sulfinic acid compounds as described in European Patent 294769A. The fixing solution or blix solution preferably contains aminopolycarboxylic acids or organic phosphonic acids for the purpose of stabilizing the solution.

In the present invention, compounds having pKa of 6.0 to 9.0 are preferably added to the fixing solution or a bleach-fixing solution in order to pH adjustment. Preferablly, imidazoles such as imidazole, 1-methylimidazole, 1-ethylimidazole, and 2-methylimidazole are added in an amount of 0.1 to 10 mol/L.

The total time required for desilvering step is preferably as short as possible so long as no maldesilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A's-60-191257, 60-191258 and 60-191259. As described in above JP-A-60-191257, such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photographic material of the present invention are subjected to washing and/or stabilization. The quantity of water to be used in the washing can be selected from a broad range depending on the characteristics of the light-sensitive material (for example, the kind of materials such as couplers, etc.), the end use of the light-sensitive material, the temperature of washing water, the number of washing tanks (number of stages), the replenishment system (e.g., counter-current system or concurrent system), and other various factors. Of these factors, the relationship between the number of washing tanks and the quantity of water in a multi-stage counter-current system can be obtained according to the method described in "Journal of the Society of Motion Picture and Television Engineers", vol. 64, pp. 248-253 (May 1955).

According to the multi-stage counter-current system described in the above reference, although the requisite amount of water can be greatly reduced, bacteria would grow due to an increase of the retention time of water in the tank, and floating masses of bacteria stick to the light-sensitive material. In the processing for the color lightsensitive material of the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", published by Sankyo Shuppan, (1986), Eisei Gijutsu Gakkai (ed.), "Biseibutsu no mekkin, sakkin, bobigijutsu", Kogyo-gijutsukai, (1982), and Nippon Bokin Bobi Gakkai (ed.), "Bokin bobizai jiten" (1986).

The washing water has a pH value of from 4 to 9, preferably from 5 to 8 in the processing for the light-sensitive material of the present invention. The temperature of the water and the washing time can be selected from broad ranges depending on the characteristics and end use of the light-sensitive material, but usually ranges from 15° C. to 45° C. in temperature and from 20 seconds to 10 minutes in time, preferably from 25° C. to 45° C. in temperature and from 30 seconds to 5 minutes in time. The light-sensitive material of the present invention may be directly processed with a stabilizer in place of the washing step. For the stabilization, any of the known techniques as described in JP-A's-57-8543, 58-14834 and 60-220345 can be used.

The aforesaid washing step may be followed by stabilization in some cases. For example, a stabilizing bath containing a dye stabilizer and a surface active agent as is used as a final bath for color light-sensitive materials for picture taking can be used. Examples of such a dye stabilizer include aldehydes such as formalin and glutaraldehyde, N-methylol compounds, hexamethylenetetramine and aldehyde-bisulfite adducts. This stabilizing bath may also contain various chelating agents or antifungal agents.

The overflow accompanying replenishment of the washing bath and/or stabilizing bath can be reused in other steps such as desilvering.

In a processing using an automatic developing machine, if the above mentioned various processing solutions are subject to concentration due to evaporation, the concentration is preferably corrected for by the addition of water.

The silver halide color light-sensitive material of the present invention may contain a color developing agent for the purpose of simplifying and expediting processing. Such a color developing agent is preferably used in the form of various precursors, when it is contained in the light-sensitive material. Examples of such precursors include indoaniline compounds as described in U.S. Pat. No. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color light-sensitive material of the present invention may optionally comprise various 1-phenyl-3-pyrazolidones for the purpose of accelerating color development. Typical examples of such compounds are described in JP-A's-56-64339, 57-144547 and 58-115438.

In the present invention, the various processing solutions are used at a temperature of 10° C. to 50° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

Further, the silver halide lightsensitive material of the invention may be applied to heat-development lightsensitive material as described, for example, in U.S. Pat. No. 4,500,626, and JP-A's-60-133449, 59-218443 and 61-238056, and European Patent 210 660A2.

Further, the silver halide color photographic lightsensitive material of the invention can exhibit advantages easily when it is applied to lens-fitted film unit described, for example, in Jap. Utility Model KOKOKU Publication Nos. 2-32615 and 3-39784, which is effective.

EXAMPLE

The present invention will be specifically described by examples below. However, the present invention is not limited to there examples.

Example-1

An epitaxial emulsion of the present invention will be described in detail below.

(Preparation of Emulsion of Present Invention)

1,100 mL of an aqueous solution containing 0.87 g of KBr and 0.95 g of low-molecular-weight oxidized gelatin having an average molecular weight of 20,000 was stirred at 35° C. An aqueous $AgNO_3$ (3.0 g) solution and an aqueous solution containing KBr (2.1 g) and low-molecular-weight oxidized gelatin (28 g) having an average molecular weight of 20,000 were added over 40 sec. An aqueous solution containing 2.6 g of KBr was added, and the temperature was raised to 50° C. After an aqueous solution containing 32 g of succinated gelatin having an average molecular weight of 100,000 was added, an aqueous solution containing 71 g of sodium catecholdisulfonate was added. After that, an aqueous $AgNO_3$ (231.4 g) solution and an aqueous KBr solution were added as first growth by the double-jet method at accelerated flow rates. During the addition, the silver potential was held at −20 mV with respect to a saturated calomel electrode. In the middle of the addition, an aqueous solution containing potassium iridium hexachloride (0.1 mg) was added. At the end of the addition of $AgNO_3$, an aqueous solution containing sodium benzenethiosulfonate (2 mg) was added. After that, an aqueous $AgNO_3$ solution (34.1 g) and an aqueous KBr solution containing KI were added over 14 min as the growth of an outermost layer. The KI concentration was so adjusted that the silver iodide content was 12 mol %. During the addition, the silver potential was held at 30 mV with respect to the saturated calomel electrode.

Next, 14 g of gelatin were added. This gelatin was formed by crosslinking alkali-processed ossein No. 1 extracted gelatin (the high-molecular-weight component was 2.5% and the low-molecular-weight component was 60.0% in the molecular weight distribution measured by the PAGI method) made from beef bones by crosslinking agent H-VI-3 described in DETAILED DESCRIPTION OF THE INVENTION. In the molecular weight distribution measured by the PAGI method, the high-molecular-weight component was 12.4%, and the low-molecular-weight component was 48.3%. After the temperature was lowered to 40° C., 9.7 mL of phenoxyethanol were added, and an aqueous KI (0.47 g) solution was added. Sensitizing dyes I, II, and III were added at a molar ratio of 69:30:1 and at a ratio of 70% of the saturated covering amount. Note that these sensitizing dyes were used as fine solid dispersions formed by a method described in JP-A-11-52507. That is, 0.8 parts by weight of sodium nitrate and 3.2 parts by weight of sodium sulfate were dissolved in 43 parts by weight of ion-exchanged water. 13 parts by weight of each sensitizing dye were added, and the solution was dispersed at 60° C. for 20 min by using a dissolver blade at 2,000 rpm, thereby obtaining a solid dispersion of the sensitizing dye. After an aqueous solution containing potassium hexacyanoruthenate(II) (3.2 mg) was added, an aqueous $AgNO_3$ (12.66 g) solution and an aqueous solution containing KBr (4.66 g), KI (0.88 g), and NaCl (3.83 g) were added over 1 min 6 sec by the double-jet method.

Epitaxial portion form stabilizing agent I (60 mg) was added, and normal washing was performed with the temperature held at 35C. After 77 g of the above-mentioned gelatin were added, at 40° C. the pH was adjusted to 6.5 and the silver potential was adjusted to 80 mV with respect to the saturated calomel electrode by using an aqueous NaCl solution. Epitaxial portion form stabilizing agent/storagebility improving agent II (6 mg) was added, the temperature was raised to 50° C., and the emulsion was optimally, chemically sensitized by adding potassium thiocyanate ($1.1\times10^{-4}$ mol), chloroauric acid ($5.5\times10^{-6}$ mol), sodium thiosulfate ($1.9\times10^{-5}$ mol), and N,N-dimethylselenourea ($4.7\times10^{-6}$ mol) per mol of a silver halide. Antifoggant I ($12.1\times10^{-4}$ mol) was added to complete the chemical sensitization.

This emulsion of the present invention consisted of tabular grains having an average equivalent-circle diameter of 0.70 μm, an equivalent-circle diameter variation coefficient of 19%, an average thickness of 0.70 μm, and an average aspect ratio of 10.0. Also, 90% or more of the total projected area were occupied by hexagonal tabular grains having (111) main planes which had an equivalent-circle diameter of 0.5 to 0.90 μm and a thickness of 0.08 μm or less, and in which the ratio of the length of an edge having a maximum length to the length of an edge having a minimum length was 5 or less. This hexagonal tabular grain had epitaxial portions Functioned to all of its six apex portions. As a result of transmission electron microscopic observation at a low temperature, 90% or more of the total projected area were occupied by grains having no dislocation lines in main planes except for the epitaxial portion, and having mesh-like dislocation lines in the epitaxial portions. FIG. 1 shows a representative photograph. In this grain, the ratio of an outermost layer containing 12 mol % of silver iodide was 12% as a silver amount. The ratio of the epitaxial portion was 4.5% as a silver amount, and its composition was AgBr(52)Cl(40)I(8). Furthermore, 90% or more of the total projected area fell within the range of 30% or less with respect to the average silver chloride content and the average silver iodide content.

Sensitizing dye I

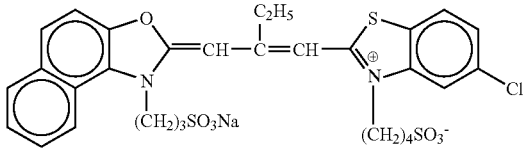

-continued

Sensitizing dye II

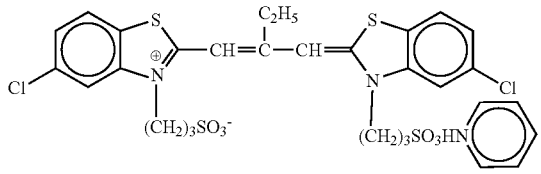

Sensitizing dye II

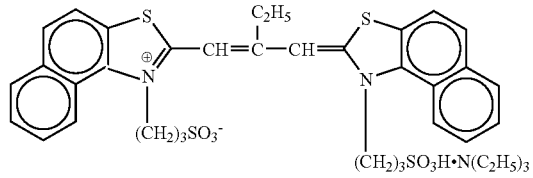

Antifoggant

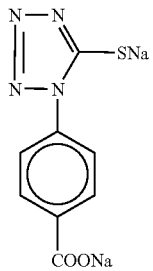

Epitaxial portion shape stabilizer I

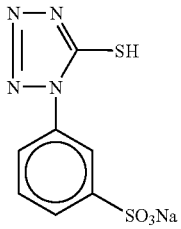

Epitaxial portion shape stabilizer as well as preservability improving agent II

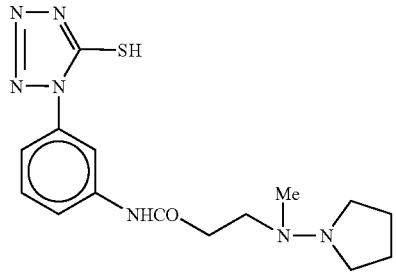

(Preparation of Emulsion of Comparative Example)

1,100 mL of an aqueous solution containing 0.87 g of KBr and 0.95 g of low-molecular-weight oxidized gelatin having an average molecular weight of 20,000 was stirred at 35° C. An aqueous $AgNO_3$ (3.0 g) solution and an aqueous solution containing KBr (2.1 g) and low-molecular-weight oxidized gelatin (28 g) having an average molecular weight of 20,000 were added over 40 sec. An aqueous solution containing 2.6 g of KBr was added, and the temperature was raised to 50C. After an aqueous solution containing 32 g of succinated gelatin having an average molecular weight of 100,000 was added, an aqueous solution containing 71 g of sodium catecholdisulfonate was added. After that, an aqueous $AgNO_3$ (199.9 g) solution and an aqueous KBr solution were added as first growth by the double-jet method at accelerated flow rates. During the addition, the silver potential was held at −20 mV with respect to a saturated calomel electrode. In the middle of the addition, an aqueous solution containing potassium iridium hexachloride (0.1 mg) was added. Subsequently, an aqueous $AgNO_3$ (32.5 g) solution and an aqueous solution containing KBr and KI were added by the double-jet method at accelerated flow rates. During the addition, the silver potential was held at −20 mV with respect to a saturated calomel electrode, and the silver iodide content was adjusted to 6.1 mol %. At the end of the addition of $AgNO_3$, an aqueous solution containing sodium benzenethiosulfonate (2 mg) was added. After that, an aqueous $AgNO_3$ solution (34.lg) and an aqueous KBr solution containing KI were added over 14 min. The KI concentration was so adjusted that the silver iodide content was 6.1 mol %.

During the addition, the silver potential was held at 30 mV with respect to the saturated calomel electrode. Next, 14 g of gelatin were added. This gelatin was alkali-processed ossein No. 1 extracted gelatin (the high-molecular-weight component was 2.5% and the low-molecular-weight component was 60.0% in the molecular weight distribution measured by the PAGI method) made from beef bones. After the temperature was lowered to 40° C., an aqueous KI (0.47 g) solution was added. Sensitizing dyes I, II, and III were added at a molar ratio of 69:30:1 and at a ratio of 70% of the saturated covering amount. Note that these sensitizing dyes were used as fine solid dispersions formed by a method described in JP-A-11-52507. That is, 0.8 parts by weight of sodium nitrate and 3.2 parts by weight of sodium sulfate were dissolved in 43 parts by weight of ion-exchanged water. 13 parts by weight of each sensitizing dye were added, and the solution was dispersed at 60° C. for 20 min by using a dissolver blade at 2,000 rpm, thereby obtaining a solid dispersion of the sensitizing dye. After an aqueous solution containing potassium hexacyanoruthenate(II) (3.2 mg) was added, an aqueous $AgNO_3$ (12.66 g) solution and an aqueous solution containing KBr (5.13 g), KI (0.22 g), and NaCl (3.83 g) were added over 1 min 6 sec by the double-jet method. Normal washing was then performed with the temperature held at 35° C. After 77 g of the above-mentioned gelatin were added, at 40° C. the pH was adjusted to 6.5 and the silver potential was adjusted to 80 mV with respect to the saturated calomel electrode by using an aqueous NaCl solution. The temperature was raised to 50° C., and the emulsion was optimally, chemically sensitized by adding potassium thiocyanate ($1.1\times10^{-4}$ mol), chloroauric acid ($5.5\times10^{-6}$ mol), sodium thiosulfate ($1.9\times10^{-5}$ mol), and N,N-dimethylselenourea ($4.7\times10^{-6}$ mol) per mol of a silver halide. Antifoggant I ($12.1\times10^{-4}$ mol) was added to complete the chemical sensitization.

This emulsion of the comparative example consisted of tabular grains having an average equivalent-circle diameter of 0.70 μm, an equivalent-circle diameter variation coefficient of 19%, an average thickness of 0.70 μm, and an average aspect ratio of 10.0. Also, 90% or more of the total projected area were occupied by hexagonal tabular grains which had (111) main planes, an equivalent-circle diameter of 0.5 to 0.90 μm and a thickness of 0.08 μm or less, and in which the ratio of the length of an edge having a maximum length to the length of an edge having a minimum length was 5 or less. This hexagonal tabular grain had an epitaxial portion junctioned to at least one apex portion. As a result of transmission electron microscopic observation at a low temperature, 40% or more of the total projected area were occupied by grains having one or more dislocation lines in main planes except for the epitaxial portion, and 50% or more of the total projected area were occupied by grains having no dislocation lines in the epitaxial portion. In this grain, the ratio of an outermost layer containing 6 mol % of silver iodide was 24% as a silver amount. The ratio of the epitaxial portion was 4.5% as a silver amount, and its composition was AgBr(58)Cl(40)I(2). Furthermore, 90% or more of the total projected area fell within the range of 30% or less with respect to the average silver chloride content and the average silver iodide content.

A cellulose triacetate film support having an undercoat layer was coated, under coating conditions as shown in Table 1 below, with the emulsions subjected to the above-mentioned chemical sensitization, and protective layers were also formed, thereby forming sample Nos. 701 and 702.

TABLE 1

| Emulsion coating condition | |
|---|---|
| (1) Emulsion layer | |
| · Emulsion . . . Each emulsion | (silver $2.1\times10^{-2}$ mol/m$^2$) |
| · Coupler | ($1.5\times10^{-3}$ mol/m$^2$) |
| 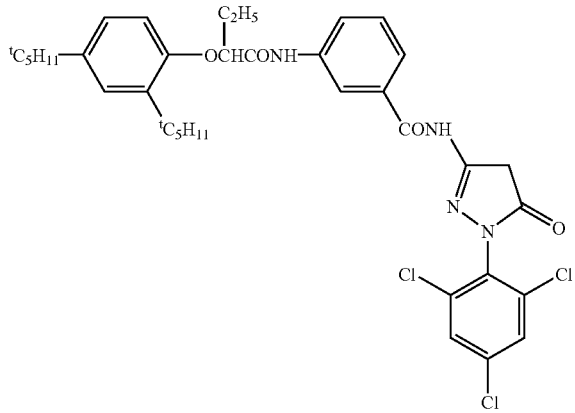 | |
| 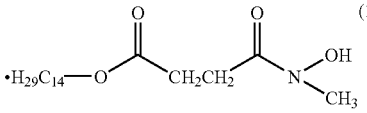 | ($1.1\times10^{-4}$ mol/m$^2$) |
| · Tricresyl phosphate | (1.10 g/m$^2$) |
| · Gelatin | (2.30 g/m$^2$) |
| (2) Protective layer | |
| · 2,4-Dichloro-6-hydroxy-s-triazine sodium salt | (0.08 g/m$^2$) |
| · Gelatin | (1.80 g/m$^2$) |

The samples were left to stand for 14 hours under the conditions of 40° C. and a relative humidity of 70%. Thereafter, the samples were exposed to light for 1/100 sec through a gelatin filter SC-50 manufactured by Fuji Photo Film Co., Ltd. and a continuous wedge.

The development was carried out by the use of automatic processor FP-360B manufactured by Fuji Photo Film Co., Ltd. under the following conditions (until the cumulatine replenishing amount of the solution reaches three times the tank volume of the mother liquid).

(Processing steps)

| Step | Time | Temp. | Quantity of replenisher* |
|---|---|---|---|
| Color development | 3 min 15 sec | 38° C. | 45 mL |
| Bleaching | 1 min 00 sec | 38° C. | 20 mL Overflow of the bleaching solution was flowed into the bleach-fixing tank |
| Bleach-Fixing | 3 min 15 sec | 38° C. | 30 mL |

-continued

| Step | (Processing steps) Time | Temp. | Quantity of replenisher* |
|---|---|---|---|
| Washing (1) | 40 sec | 35° C. | Counter current pipe Arrangement from (2) to (1) |
| Washing (2) | 1 min 00 sec | 35° C. | 30 mL |
| Stabilization | 40 sec | 38° C. | — |
| Drying | 1 min 15 sec | 55° C. | |

*The replenishment rate is a value per 1.1 m of a 35-mm wide lightsensitive material (equivalent to one 24 Ex. film).

The composition of each of the processing solutions was as follows.

| | Tank Solution (g) | Replenisher (g) |
|---|---|---|
| (Color Developer) | | |
| Diethylenetriaminepentaacetic acid | 1.0 | 1.1 |
| 1-Hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-(β-hydroxyethyl)amino]2-Methyl-aniline sulfate | 4.5 | 5.5 |
| Water to make | 1.0 L | 1.0 L |
| pH (adjusted by potassium hydroxide and sulfuric acid) | 10.05 | 10.10 |

| | Common to both tank solution and reprenisher |
|---|---|
| (Bleaching Solution) | |
| Ammonium ethylenediamine tetraacetato ferrate dihydrate | 120.0 |
| Disodium ethylenediaminetetraacetic acid | 10.0 |
| Ammonium bromide | 100.0 |
| Ammonium nitrate | 10.0 |
| Bleach accelerator $(CH_3)_2N—CH_2—CH_2—S—S—CH_2—CH_2—CH_2—N(CH_3)_2.2HCl$ | 0.005 mole |
| Aqueous ammonia | 15.0 mL |
| Water to make | 1.0 L |
| pH (adjusted by aqueous ammonia and nitric acid) | 6.3 |

| | Tank Solution (g) | Replenisher (g) |
|---|---|---|
| (Bleach-Fixing Solution) | | |
| Ammonium ethylenediamine tetraacetato ferrate dihydrate | 50.0 | — |
| Disodium ethylenediaminetetraacetic Acid | 5.0 | 2.0 |
| Sodium sulfite | 12.0 | 20.0 |
| Aqueous solution of ammonium thiosulfate (700 g/L) | 240.0 mL | 400.0 mL |
| Aqueous ammonia | 6.0 mL | — |
| Water to make | 1.0 L | 1.0 L |
| pH (adjusted by aqueous ammonia and acetic acid) | 7.2 | 7.3 |

(Washing Water) Common to Both Tank Solution and Reprenisher

Tap water was passed through a mixed bed column filled with an H-type strongly acidic cation exchange resin (Amberlite IR-120B, produced by Rhom and Haas) and an OH-type strongly basic anion exchange resin (Amberlite IR-400, produced by the same company) to reduce the calcium and magnesium ion concentrations each to 3 mg/L or less and then thereto 20 mg/L of sodium isocyanurate dichloride and 150 mg/L of sodium sulfate were added. The resulting solution had a pH of from 6.5 to 7.5.

| | Common to both tank solution and reprenisher (unit: g) |
|---|---|
| (Stabilizing Solution) | |
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 L |
| PH | 8.5 |

The density of each processed sample was measured through a green filter. Also, samples stored at 50° C. and a relative humidity of 60% for 14 days before exposure were similarly evaluated, thereby evaluating the storagebility.

Table 2 below shows the values of sensitivity and fog obtained at a density of fog plus 0.2 as described above.

TABLE 2

| Sample No. | Emulsion | Fresh Fog | Fresh Sensitivity | After storage Fog | After storage Sensitivity |
|---|---|---|---|---|---|
| 701 | Emulsion of the invention | 0.14 | 178 | 0.16 | 175 |
| 702 | Emulsion for comparison | 0.19 | 100 | 0.31 | 81 |

As is obvious from the results shown in Table 2, a high-speed light-sensitive material having a low fog can be obtained by using tabular grains of the present invention in which 70% or more of the total projected area were occupied by grains having an epitaxial portion junctioned to at least one apex portion and having at least one dislocation line in the epitaxial portion. Furthermore, changes in fog and sensitivity after storage are small.

Example-2

The structure of silver iodide of a host tabular grain will be described below.

(Preparation of Tabular-grain Emulsion a)

1,500 mL of an aqueous solution containing 4.1 g of KBr and 7.1 g of low-molecular-weight oxidized gelatin having an average molecular weight of 20,000 was stirred at 40° C. An aqueous $AgNO_3$ (8.4 g) solution and an aqueous solution containing KBr (5.9 g) and KI (1.11 g) were added over 40 sec. An aqueous solution containing 35.5 g of succinated gelatin having an average molecular weight of 100,000 were added, and the temperature was raised to 58° C. After that, an aqueous $AgNO_3$ (184.7 g) solution and an aqueous KBr solution were added as first growth by the double-jet method at accelerated flow rates. During the addition, the silver potential was held at −20 mV with respect to a saturated calomel electrode. In the middle of the addition, potassium iridium hexachloride and sodium benzenethiosulfonate were added. After that, an aqueous $AgNO_3$ solution (21.5 g) and an aqueous KBr solution containing KI were added over 5 min as the growth of an outermost layer. The KI concentration was so adjusted that the silver iodide content was 17 mol %. During the addition, the silver potential was held at 0 mV with respect to the saturated calomel electrode. Normal washing was performed, gelatin having an average molecular weight of 100,000 was added, and the pH and the silver potential were adjusted to 5.5 and 30 mV, respectively, at 40° C. This emulsion was named emulsion a.

The emulsion a consisted of tabular grains having an average equivalent-circle diameter of 0.83 μm, an equivalent-circle diameter variation coefficient of 19%, an average thickness of 0.086 μm, and an average aspect ratio of 9.7. Also, 90% or more of the total projected area were occupied by hexagonal tabular grains having (111) main planes, and which had an equivalent-circle diameter of 0.5 to 1.0 μm and a thickness of 0.1 μm or less, and in which the ratio of the length of an edge having a maximum length to the length of an edge having a minimum length was 5 or less. As a result of transmission electron microscopic observation at a low temperature, no dislocation lines were found. The (111) face ratio in side faces was 65%. In this grain, the ratio of an outermost layer having 17 mol % of silver iodide was 10% as a silver amount.

(Preparation of Tabular-grain Emulsions b, c, d, e, f, g, h, i, and j)

Emulsions b, c, d, e, f, g, h, i, and j were prepared by changing the silver ratios in the first growth and in the outermost layer growth of the emulsion a and by changing the silver iodide content of the outermost layer. The grain shape and the like were matched with those of the emulsion a by adjusting the silver potential and the like. Table 3 shows the silver amount and silver iodide amount of the outermost layer of each tabular-grain emulsion. The coefficients of variation of equivalent circle diameters of Emulsions b to j were almost equal to that of Emulsion a.

TABLE 3

| Emulsion | Amount of Outermost layer in terms of silver (%) | Silver iodide content of outermost layer (%) |
|---|---|---|
| a | 10 | 17 |
| b | 15 | 17 |
| c | 20 | 17 |
| d | 30 | 17 |
| e | 40 | 17 |
| f | 5 | 17 |
| g | 10 | 7 |
| h | 10 | 12 |
| i | 10 | 22 |
| j | 10 | 30 |

(Epitaxial Junction)

Epitaxial deposition processes (1) to (3) described below were performed for the host tabular-grain emulsions a to j.

(1) The host tabular-grain emulsion was dissolved at 40° C., and $2.4\times10^{-3}$ mol of an aqueous KI solution was added per mol of the silver amount of the host tabular grains. Sensitizing dyes I, II, and III were added at a molar ratio of 69:30:1 and at a ratio of 70% of the saturated covering amount. These sensitizing dyes were used as fine solid dispersions formed by a method described in JP-A-11-52507. That is, 0.8 parts by weight of sodium nitrate and 3.2 parts by weight of sodium sulfate were dissolved in 43 parts by weight of ion-exchanged water. 13 parts by weight of each sensitizing dye were added and dispersed at 60° C. for 20 min by using a dissolver blade at 2,000 rpm, thereby obtaining a fine solid dispersion of the sensitizing dye. $8.1\times10^{-6}$ mol (per mol of the silver amount of the host tabular grains; the same shall apply hereinafter) of potassium hexacyanoruthenate(II) was added, and $1.18\times10^{-2}$ mol of an aqueous KBr solution was added. After that, $3.56\times10^{-2}$ mol of an aqueous 1 mol/L silver nitrate solution and $3.14\times10^{-2}$ mol of an aqueous NaCl solution were added at fixed flow rates over 10 min by the double-jet method. At the end of the addition, the silver potential was +85 mV with respect to a saturated calomel electrode. After $3.87\times10^{-5}$ mol of antifoggant I was added, the emulsion was heated to 50° C. and optimally, chemically sensitized by adding potassium thiocyanate ($6.6\times10^{-4}$ mol), chloroauric acid ($7.9\times10^{-6}$ mol), sodium thiosulfate ($2.7\times10^{-5}$ mol), and N,N-dimethylselenourea ($4.7\times10^{-6}$ mol) $6.6\times10^{-4}$ mol of antifoggant I was added to complete the chemical sensitization.

(2) The host tabular-grain emulsion was dissolved at 38° C., and $2.4\times10^{-3}$ mol of an AgI fine-grain emulsion was added per mol of the silver amount of the host tabular grains. Sensitizing dyes I, II, and III were added at a molar ratio of 69:30:1 and at a ratio of 70% of the saturated covering amount. These sensitizing dyes were used as fine solid dispersions formed by the method described in JP-A-11-52507. That is, 0.8 parts by weight of sodium nitrate and 3.2 parts by weight of sodium sulfate were dissolved in 43 parts by weight of ion-exchanged water. 13 parts by weight of each sensitizing dye were added and dispersed at 60° C. for 20 min by using a dissolver blade at 2,000 rpm, thereby obtaining a fine solid dispersion of the sensitizing dye. $8.1\times10^{-6}$ mol (per mol of the silver amount of the host tabular grains; the same shall apply hereinafter) of potassium hexacyanoruthenate(II) was added, and $1.18\times10^{-2}$ mol of an aqueous KBr solution was added. After $3.14\times10^{-2}$ mol of an aqueous NaCl solution was added, $3.56\times10^{-2}$ mol of an aqueous 0.1 mol/L silver nitrate solution was added at a fixed flow rate over 1 min. At the end of the addition, the silver potential was +85 mV with respect to a saturated calomel electrode. After $3.87\times10^{-5}$ mol of antifoggant I was added, the emulsion was chemically sensitized in the same manner as in (1).

(3) The host tabular-grain emulsion was dissolved at 38° C., and the pH was adjusted to 5.0. $2.4\times10^{-3}$ mol of an AgI fine-grain emulsion was added per mol of the silver amount of the host tabular grains. Sensitizing dyes I, II, and III were added at a molar ratio of 69:30:1 and at a ratio of 70% of the saturated covering amount. These sensitizing dyes were used as fine solid dispersions formed by the method described in JP-A-11-52507. That is, 0.8 parts by weight of sodium nitrate and 3.2 parts by weight of sodium sulfate were dissolved in 43 parts by weight of ion-exchanged water. 13 parts by weight of each sensitizing dye were added and dispersed at 60° C. for 20 min by using a dissolver blade at 2,000 rpm, thereby obtaining a fine solid dispersion of the sensitizing dye. $8.1\times10^{-6}$ mol (per mol of the silver amount of the host tabular grains; the same shall apply hereinafter) of potassium hexacyanoruthenate(II) was added, and $1.18\times10^{-2}$ mol of an aqueous KBr solution was added. After that, $3.56\times10^{-2}$ mol of an aqueous 0.1 mol/L silver nitrate solution and $3.14\times10^{-2}$ mol of an aqueous NaCl solution were added at fixed flow rates over 2 min. At the end of the addition, the silver potential was +85 mV with respect to a saturated calomel electrode. After $3.87\times10^{-5}$ mol of antifoggant I was added, the emulsion was chemically sensitized in the same manner as in (1).

The distributions of silver iodide content and silver chloride content between grains of each of the emulsions prepared by combining the above epitaxial deposition processes and the host tabular grain emulsions were measured using the EPMA method. Also, the state of epitaxial deposition was observed with an electron microscope by using a replica. The results are shown in Table 4. The average silver chloride content was 2.1 mol %.

TABLE 4

| Host tabular grain emulsion | Method of epitaxial junction | Remarks | Ratio of grains containing a silver chloride content within a range of 0.7 to 1.3 CL (%) | Ratio of grains containing a silver iodide content within a range of 0.7 to 1.3 I (%) | Ratio of grains containing epitaxial junction at one or more apex portions (%) |
|---|---|---|---|---|---|
| a | (1) | Comp. | 60 | 80 | 60 |
| a | (2) | Inv. | 80 | 90 | 80 |
| a | (3) | Inv. | 90 | 90 | 90 |
| b | (1) | Comp. | 60 | 80 | 60 |
| b | (2) | Inv. | 80 | 90 | 80 |
| b | (3) | Inv. | 90 | 90 | 90 |
| c | (1) | Comp. | 60 | 70 | 50 |
| c | (2) | Inv. | 80 | 80 | 70 |
| c | (3) | Inv. | 90 | 80 | 80 |
| d | (1) | Comp. | 50 | 60 | 60 |
| d | (2) | Comp. | 70 | 70 | 70 |
| d | (3) | Comp. | 80 | 70 | 80 |
| e | (1) | Comp. | 50 | 50 | 50 |
| e | (2) | Comp. | 60 | 60 | 60 |
| e | (3) | Comp. | 70 | 60 | 70 |
| f | (1) | Comp. | 50 | 80 | 50 |
| f | (2) | Comp. | 70 | 90 | 60 |
| f | (3) | Inv. | 80 | 90 | 70 |
| g | (1) | Comp. | 50 | 80 | 50 |

TABLE 4-continued

| Host tabular grain emulsion | Method of epitaxial junction | Remarks | Ratio of grains containing a silver chloride content within a range of 0.7 to 1.3 CL (%) | Ratio of grains containing a silver iodide content within a range of 0.7 to 1.3 I (%) | Ratio of grains containing epitaxial junction at one or more apex portions (%) |
|---|---|---|---|---|---|
| g | (2) | Comp. | 60 | 90 | 60 |
| g | (3) | Comp. | 70 | 90 | 60 |
| h | (1) | Comp. | 60 | 80 | 60 |
| h | (2) | Comp. | 70 | 90 | 65 |
| h | (3) | Inv. | 80 | 90 | 70 |
| i | (1) | Inv. | 60 | 70 | 70 |
| i | (2) | Inv. | 80 | 80 | 80 |
| i | (3) | Inv. | 90 | 80 | 90 |
| j | (1) | Comp. | 50 | 60 | 60 |
| j | (2) | Inv. | 70 | 70 | 70 |
| j | (3) | Inv. | 80 | 70 | 80 |

Additionally, dislocation lines in epitaxial portions were observed with a transmission electron microscope at a low temperature. The results are shown in Table 5.

TABLE 5

| Host tabular grain emulsion | Method of epitaxial junction | Remarks | Ratio of grains containing a dislocation line at epitaxial portion (%) |
|---|---|---|---|
| a | (1) | Comp. | 30 |
| a | (2) | Inv. | 70 |
| a | (3) | Inv. | 80 |
| b | (1) | Comp. | 40 |
| b | (2) | Inv. | 70 |
| b | (3) | Inv. | 80 |
| c | (1) | Comp. | 50 |
| c | (2) | Inv. | 70 |
| c | (3) | Inv. | 80 |
| d | (1) | Comp. | 60 |
| d | (2) | Comp. | 60 |
| d | (3) | Comp. | 50 |
| e | (1) | Comp. | 40 |
| e | (2) | Comp. | 20 |
| e | (3) | Comp. | 20 |
| f | (1) | Comp. | 30 |
| f | (2) | Comp. | 50 |
| f | (3) | Inv. | 70 |
| g | (1) | Comp. | 30 |
| g | (2) | Comp. | 40 |
| g | (3) | Comp. | 40 |
| h | (1) | Comp. | 50 |
| h | (2) | Comp. | 50 |
| h | (3) | Inv. | 70 |
| i | (1) | Inv. | 70 |
| i | (2) | Inv. | 80 |
| i | (3) | Inv. | 90 |
| j | (1) | Comp. | 60 |
| j | (2) | Inv. | 70 |
| j | (3) | Inv. | 80 |

As is apparent from the results shown in Tables 4 and 5, in accordance with the silver iodide content and silver amount of the outermost layer of the host tabular-grain emulsion and with the method of epitaxial junction, the ratio of grains having an epitaxial portion junctioned to at least one apex portion and the ratio of grains having dislocation lines in an epitaxial portion change. When the silver iodide content and silver amount of the outermost layer fall within the preferred ranges of the present invention, the ratio of grains having an epitaxial portion junctioned to at least one apex portion and having dislocation lines in the epitaxial portion increase. Letting CL mol % be the average silver chloride content of all silver halide grains, the higher the ratio at which the silver chloride content is 0.7CL to 1.3CL, the higher the ratio of grains having an epitaxial portion junctioned to at least one apex portion. Letting I mol % be the average silver iodide content of all silver halide grains, the higher the ratio at which the silver iodide content is 0.7I to 1.3I, the higher the ratio of grains having an epitaxial portion junctioned to at least one apex portion. Also, even when the preferred silver iodide amount and silver amount of the outermost layer of the present invention are satisfied, the ratio of grains having an epitaxial portion junctioned to at least one apex portion greatly changes in accordance with the method of epitaxial junction. That is, when the pH of epitaxial junction is set within the favored range of the present invention, the ratio of grains having an epitaxial portion junctioned to at least one apex portion can be significantly increased.

A cellulose triacetate film support having an undercoat layer was coated, under the same coating conditions as in Example 1, with the emulsions subjected to the above chemical sensitization, and protective layers were also formed, thereby forming sample Nos. 1 to 30.

These samples were exposed and processed following the same procedures as in Example 1. The density of each processed sample was measured through a green filter. Also, samples stored at 50° C. and a relative humidity of 60% for 14 days before exposure were similarly evaluated, thereby evaluating the storagebility.

Table 6 below shows the values of sensitivity and fog obtained at a density of fog plus 0.2 as described above.

TABLE 6

| Sample No. | Host tabular grain emulsion | Method of epitaxial junction | Remarks | Fresh performance Fog | Fresh performance Sensitivity | After storage performance Fog | After storage performance Sensitivity |
|---|---|---|---|---|---|---|---|
| 1 | a | (1) | Comp. | 0.25 | 118 | 0.33 | 98 |
| 2 | a | (2) | Inv. | 0.17 | 203 | 0.21 | 193 |
| 3 | a | (3) | Inv. | 0.16 | 218 | 0.20 | 208 |
| 4 | b | (1) | Comp. | 0.24 | 128 | 0.32 | 108 |
| 5 | b | (2) | Inv. | 0.18 | 203 | 0.22 | 193 |
| 6 | b | (3) | Inv. | 0.16 | 212 | 0.20 | 202 |
| 7 | c | (1) | Comp. | 0.25 | 80 | 0.34 | 55 |
| 8 | c | (2) | Inv. | 0.20 | 181 | 0.25 | 176 |
| 9 | c | (3) | Inv. | 0.20 | 175 | 0.25 | 160 |
| 10 | d | (1) | Comp. | 0.33 | 48 | 0.46 | 23 |
| 11 | d | (2) | Comp. | 0.28 | 54 | 0.40 | 29 |
| 12 | d | (3) | Comp. | 0.25 | 54 | 0.37 | 29 |
| 13 | e | (1) | Comp. | 0.35 | 38 | 0.55 | 13 |
| 14 | e | (2) | Comp. | 0.32 | 48 | 0.45 | 23 |
| 15 | e | (3) | Comp. | 0.28 | 54 | 0.40 | 29 |
| 16 | f | (1) | Comp. | 0.25 | 88 | 0.34 | 63 |
| 17 | f | (2) | Comp. | 0.25 | 109 | 0.33 | 89 |
| 18 | f | (3) | Inv. | 0.18 | 195 | 0.22 | 185 |
| 19 | g | (1) | Comp. | 0.40 | 38 | 0.60 | 13 |
| 20 | g | (2) | Comp. | 0.31 | 48 | 0.44 | 23 |
| 21 | g | (3) | Comp. | 0.29 | 54 | 0.41 | 29 |
| 22 | h | (1) | Comp. | 0.25 | 68 | 0.34 | 43 |
| 23 | h | (2) | Comp. | 0.25 | 80 | 0.34 | 55 |
| 24 | h | (3) | Inv. | 0.18 | 195 | 0.22 | 185 |
| 25 | i | (1) | Inv. | 0.20 | 195 | 0.25 | 180 |
| 26 | i | (2) | Inv. | 0.16 | 203 | 0.20 | 193 |
| 27 | i | (3) | Inv. | 0.16 | 212 | 0.20 | 202 |
| 28 | j | (1) | Comp. | 0.25 | 101 | 0.33 | 81 |
| 29 | j | (2) | Inv. | 0.20 | 181 | 0.25 | 170 |
| 30 | j | (3) | Inv. | 0.19 | 195 | 0.23 | 185 |

As is evident from the results shown in Table 6, the fog lowers and the sensitivity rises when the ratio of grains of the present invention having an epitaxial portion junctioned to at least one apex portion and having dislocation lines in the epitaxial portion increases. Letting CL mol % denote the specific silver chloride content, this effect increases as the ratio at which the silver chloride content is 0.7CL to 1.3CL increases. Also, letting I mol % denote the specific silver iodide content, the effect increases as the ratio at which the silver iodide content is 0.7I to 1.3I increases. Furthermore, the effect of the present invention is conspicuous when the pH of epitaxial junction is set within the preferred range of the present invention. Changes in fog and sensitivity after storage are also small. Note that the effect of the present invention was small when host tabular grains containing dislocation lines were used.

Example-3

The effect of gelatin of the present invention will be explained below.

The following gelatins were used in the preparation of emulsions.

(Gelatin 1) Alkali-processed ossein No. 1 extracted gelatin made from beef bones. In the molecular weight distribution measured by the PAGI method, the high-molecular-weight component was 2.5%, and the low-molecular-weight component was 60.0%.

(Gelatin 2) Gelatin formed by adding phthalic anhydride to an aqueous solution of gelatin 1 at 50° C. and pH 9.0 to cause a chemical reaction, removing the residual phthalic acid, and drying the resultant material. 95% of amino groups in the gelatin were chemically modified.

(Gelatin 3) Gelatin formed by decreasing the molecular weight of gelatin 1 by allowing decomposing enzyme to act on an aqueous solution of gelatin 1 such that the average molecular weight was 15,000, and then deactivating the enzyme and drying the resultant material.

(Gelatin 4) A mixture of No. 2 and No. 3 extracted products of gelatin 1. In the molecular weight distribution measured by the PAGI method, the high-molecular-weight component was 9.8%, and the low-molecular-weight component was 49.5%.

(Gelatin 5) A mixture of No. 6 and No. 7 extracted products of gelatin 1. In the molecular weight distribution measured by the PAGI method, the high-molecular-weight component was 32.0%, and the low-molecular-weight component was 30.5%.

(Gelatin 6) Gelatin formed by crosslinking gelatin 1 by transglutaminase enzyme explained in DETAILED DESCRIPTION OF THE INVENTION. In the molecular weight distribution measured by the PAGI method, the high-molecular-weight component was 10.1%, and the low-molecular-weight component was 48.6%.

(Gelatin 7) Gelatin formed by crosslinking gelatin 1 by crosslinking agent H-I-1 explained in DETAILED DESCRIPTION OF THE INVENTION. In the molecular weight distribution measured by the PAGI method, the high-molecular-weight component was 6.6%, and the low-molecular-weight component was 49.1%.

(Gelatin 8) Gelatin formed by crosslinking gelatin 1 by crosslinking agent H-II-4 explained in DETAILED DESCRIPTION OF THE INVENTION. In the molecular weight distribution measured by the PAGI method, the high-molecular-weight component was 11.8%, and the low-molecular-weight component was 42.5%.

(Gelatin 9) Gelatin formed by crosslinking gelatin 1 by crosslinking agent H-VI-3 explained in DETAILED DESCRIPTION OF THE INVENTION. In the molecular weight distribution measured by the PAGI method, the high-molecular-weight component was 8.2%, and the low-molecular-weight component was 48.2%.

(Gelatin 10) Gelatin formed by crosslinking gelatin 1 by crosslinking agent H-VI-3 explained in DETAILED DESCRIPTION OF THE INVENTION. In the molecular weight distribution measured by the PAGI method, the high-molecular-weight component was 26.0%, and the low-molecular-weight component was 34.7%.

(Gelatin 11) Gelatin formed by crosslinking gelatin 1 by crosslinking agent H-VI-3 explained in DETAILED DESCRIPTION OF THE INVENTION. In the molecular weight distribution measured by the PAGI method, the high-molecular-weight component was 34.3%, and the low-molecular-weight component was 29.9%.

(Gelatin 12) Gelatin formed by crosslinking gelatin 1 by crosslinking agent H-VI-3 explained in DETAILED DESCRIPTION OF THE INVENTION. In the molecular weight distribution measured by the PAGI method, the high-molecular-weight component was 12.4%, and the low-molecular-weight component was 48.3%.

All of gelatins 1 to 12 described above were deionized and so adjusted that the pH of an aqueous 5% solution at 35° C. was 6.0.

(Preparation of Tabular Grain Emulsion k) 1,500 mL of an aqueous solution containing 4.1 g of KBr and 1.9 g of gelatin 3 was stirred at 35° C. An aqueous $AgNO_3$ (8.4 g) solution and an aqueous solution containing KBr (5.9 g), KI (1.11 g), and 4.7 g of gelatin 3 were added over 30 sec. An aqueous solution containing 35.5 g of gelatin 2 was added, and the temperature was raised to 58° C. After that, an aqueous $AgNO_3$ (184.7 g) solution, an aqueous KBr solution, and an aqueous solution of gelatin 3 were added as first growth immediately after being mixed in another chamber having a magnetic coupling induction type stirrer described in JP-A-10-43570. During the addition, the silver potential was held at −25 mV with respect to a saturated calomel electrode. In the middle of the addition, potassium iridium hexachloride and sodium benzenethiosulfonate were added.

After that, an aqueous $AgNO_3$ solution (21.5 g), an aqueous KBr solution, an a previously prepared AgI ultrafine-grain emulsion were added as the growth of an outermost layer by the triple-jet method over 10 min. The addition amount of the AgI ultrafine-grain emulsion was so adjusted that the silver iodide content was 17 mol %. During the addition, the silver potential was held at 0 mV with respect to the saturated calomel electrode. Normal washing was performed, gelatin 1 was added in an amount of 50 g per mol of silver, and the pH and the silver potential were adjusted to 5.0 and 30 mV, respectively, at 40° C. This emulsion was named emulsion k. The emulsion k consisted of tabular grains having an average equivalent-circle diameter of 0.76 μm, an equivalent-circle diameter variation coefficient of 18%, an average thickness of 0.068 μm, and an average aspect ratio of 11.2. Also, 90% or more of the total projected area were occupied by hexagonal tabular grains having (111) main planes, and which had an equivalent-circle diameter of 0.5 to 1.0 μm and a thickness of 0.08 μm or less, and in which the ratio of the length of an edge having a maximum length to the length of an edge having a minimum length was 1.5 or less. As a result of transmission electron microscopic observation at a low temperature, no dislocation lines were found. The (111) face ratio in side faces was 60%. In this grain, the ratio of an outermost layer having 17 mol % of silver iodide was 10% as a silver amount.

(Preparation of Tabular-grain Emulsions l, m, n, o, p, q, r, s, and t)

Emulsions l to t were prepared by changing gelatin 1 added after washing of emulsion k to gelatins 4 to 12. The grain shape and the like were the same as those of emulsion k.

(Epitaxial Junction)

The emulsions k to t were dissolved at 38° C., and $2.8\times10^{-3}$ mol of an AgI fine-grain emulsion was added per mol of the silver amount of the host tabular grains. Sensitizing dyes I, II, and III used in Example 1 were added at a molar ratio of 69:30:1 and at a ratio of 75% of the saturated covering amount. These sensitizing dyes were used as fine solid dispersions formed by the method described in JP-A-11-52507. That is, 0.8 parts by weight of sodium nitrate and 3.2 parts by weight of sodium sulfate were dissolved in 43 parts by weight of ion-exchanged water. 13 parts by weight of the sensitizing dye were added and dispersed at 60° C. for 20 min by using a dissolver blade at 2,000 rpm, thereby obtaining a fine solid dispersion of the sensitizing dye. $2.7\times10^{-5}$ mol (per mol of the silver amount of the host tabular grains; the same shall apply hereinafter) of potassium hexacyanoruthenate(II) was added, and $3.9\times10^{-3}$ mol of an AgI fine-grain emulsion was added. After that, $3.56\times10^{-2}$ mol of an aqueous 0.1 mol/L silver nitrate solution and an aqueous solution containing NaCl ($3.14\times10^{-2}$ mol) and KBr ($1.18\times10^{-2}$ mol) were added at fixed flow rates over 1 min by the double-jet method. At the end of the addition, the silver potential was +85 mV with respect to a saturated calomel electrode. After $4.01\times10^{-5}$ mol of antifoggant I used in Example 1 was added, the emulsion was heated to 50° C. and optimally, chemically sensitized by adding potassium thiocyanate ($3.3\times10^{-4}$ mol), chloroauric acid ($8.3\times10^{-6}$ mol), sodium thiosulfate ($1.3\times10^{-5}$ mol), and N,N-dimethylselenourea ($9.2\times10^{-6}$ mol). $6.9\times10^{-4}$ mol of antifoggant I was added to complete the chemical sensitization.

The state of epitaxial deposition was observed with an electron microscope by using a replica. Also, the filtering characteristics of the emulsions were evaluated. That is, each emulsion was dissolved at 45° C., and the filtering pressure change (the value obtained by dividing the filtering pressure value 20 minutes after the start of filtration by the initial filtering pressure value immediately after the start of filtration; a change of 1, i.e., no change is preferred) of the solution was measured. The filtering conditions were a filtering sectional area of 3.14 $cm^2$, a filtering flow rate of 100 mL/min, and a filter mesh size of 5 μm. Sample Nos. 101 to 110 were formed by coating following the same procedures as in Example 1, and these samples were exposed and developed. The results are shown in Table 7 below.

TABLE 7

| Sample No. | Emulsion | Ratio of grains containing epitaxial portion junctioned to one or more apex portions (%) | Ratio of change in filtration property | Fresh performance Fog | Fresh performance Sensitivity | After storage performance Fog | After storage performance Sensitivity |
|---|---|---|---|---|---|---|---|
| 101 (Inv.) | k | 85 | 1.6 | 0.14 | 100 | 0.19 | 87 |
| 102 (Inv.) | l | 95 | 1.1 | 0.13 | 121 | 0.17 | 111 |
| 103 (Inv.) | m | 90 | 30 or more | 0.12 | 106 | 0.15 | 96 |
| 104 (Inv.) | n | 90 | 1.2 | 0.13 | 129 | 0.17 | 119 |
| 105 (Inv.) | o | 95 | 1.1 | 0.13 | 129 | 0.17 | 119 |
| 106 (Inv.) | p | 95 | 1.0 | 0.13 | 136 | 0.16 | 128 |
| 107 (Inv.) | q | 95 | 1.1 | 0.13 | 136 | 0.16 | 128 |
| 108 (Inv.) | r | 95 | 1.4 | 0.11 | 111 | 0.15 | 100 |
| 109 (Inv.) | s | 95 | 30 or more | 0.10 | 106 | 0.14 | 98 |
| 110 (Inv.) | t | 95 | 1.0 | 0.13 | 111 | 0.16 | 100 |

Additionally, transmission electron microscopic observation was performed at a low temperature. The results of dislocation lines in epitaxial portions are shown in Table 8.

TABLE 8

| Emulsion | Remarks | Ratio of grains containing dislocation line at epitaxial portion (%) |
|---|---|---|
| k | Inv. | 80 |
| l | Inv. | 90 |
| m | Inv. | 90 |
| n | Inv. | 90 |
| o | Inv. | 95 |
| p | Inv. | 95 |
| q | Inv. | 95 |
| r | Inv. | 90 |
| s | Inv. | 95 |
| t | Inv. | 85 |

As shown in Tables 7 and 8, the use of preferred gelatin of the present invention improves the filtering characteristics and increases the ratio of grains having an epitaxial portion Functioned to at least one apex portion and having dislocation lines in the epitaxial portion. Also, both the fresh sensitivity/fog ratio and the sensitivity/fog ratio after storage improve. However, the filtering characteristics of an emulsion using gelatin having an excessively increased high-molecular-weight component extremely deteriorate. The effect of preferred gelatin of the present invention was small when tabular grains having an equivalent-circle diameter larger than 1.2 μm were used.

Example-4

Advantages of the emulsions of the invention exerted in a multi-layered color photographic lightsensitive material will be demonstrated below.

Silver halide emulsions Em-A to Em-M were prepared by the following methods.

(Preparation of Em-A)

42.2L of an aqueous solution containing 31.7 g of a low-molecular-weight gelatin of 15,000 molecular weight converted to phthalate at a ratio of 97% and 31.7 g of KBr was vigorously agitated while maintaining the temperature at 35° C. 1583 mL of an aqueous solution containing 316.7 g of $AgNO_3$ and 1583 mL of an aqueous solution containing 221.5 g of KBr and 52.7 g of a low-molecular-weight gelatin whose molecular weight was 15,000 were added by the double jet method over a period of 1 min. Immediately after the completion of the addition, 52.8 g of KBr was added, 2485 mL of an aqueous solution containing 398.2 g of $AgNO_3$ and 2581 mL of an aqueous solution containing 291.1 g of KBr were added by the double jet method over a period of 2 min. Immediately after the completion of the addition, 44.8 of KBr was added and heated to 40° C., and the mixture was ripened. After the completion of the ripening, 923 g of a gelatin of 100,000 molecular weight converted to phthalate at a ratio of 97% and 79.2 g of KBr were added, and an aqueous solution of KBr and 15,947 mL of an aqueous solution containing 5103 g of $AgNO_3$ were added by the double jet method over a period of 10 min while increasing the flow rate so that the final flow rate was 1.4 times the initial flow rate. During this period, the silver potential was maintained at −60 mV against saturated calomel electrode. The mixture was washed with water, and gelatin was added, effecting adjustments to a pH of 5.7, a pAg of 8.8, and a gelatin weight to 64.1 g and weight of the emulsion, in terms of silver, to 131.8 g per kg of emulsion. Thus, a seed emulsion was obtained.

1211 mL of an aqueous solution containing 46 g of a gelatin converted to phthalate at a ratio of 97% and 1.7 g of KBr was vigorously agitated while maintaining the temperature at 75° C. 9.9 g of the above seed emulsion and then 0.3 g of modified silicon oil (L7602, produced by Nippon Unicar Company, Limited) were added thereto. $H_2SO_4$ was added to thereby adjust the pH to 5.5, and 67.6 mL of an aqueous solution containing 7.0 g of $AgNO_3$ and an aqueous solution of KBr were added by the double jet method over a period of 6 min while increasing the flow rate so that the final flow rate was 5.1 times the initial flow rate. During this period, the silver potential was maintained at −20 mV against saturated calomel electrode. 2 mg of sodium benzenethiosulfonate and 2 mg of thiourea dioxide were added, and 328 mL of an aqueous solution containing 105.6 g of $AgNO_3$ and an aqueous solution of KBr were added by the double jet method over a period of 56 min while increasing the flow rate so that the final flow rate was 3.7 times the initial flow rate. During this period, a AgI fine grain emulsion of 0.037 μm grain size was simultaneously added while conducting a flow rate increase so that the silver iodide content was 27 mol %, and the silver potential was maintained at −50 mV against saturated calomel electrode. Still further, an aqueous solution of KBr and 121.3 mL of an aqueous solution containing 45.6 g of $AgNO_3$ were added by the double jet method over a period of 22 min. During this period, the silver potential was maintained at +20 mV against saturated calomel electrode.

The mixture was heated to 82° C., and KBr was added to thereby adjust the silver potential to −80 mV. Thereafter, the above AgI fine grain emulsion was added in an amount, in terms of the weight of KI, of 6.33 g. Immediately after the completion of the addition, 206.2 mL of an aqueous solution containing 66.4 g of $AgNO_3$ was added over a period of 16 min. For 5 min in the initial stage of addition, the silver potential was maintained at −80 mV by the use of an aqueous solution of KBr. The mixture was washed with water, and gelatin was added, adjusting the pH and pAg thereof at 40° C. to 5.8 and 8.7, respectively. Compounds 11 and 12 were added, and the mixture was heated to 60° C. Sensitizing dyes 11 and 12 were added in the form of a solid fine dispersion, and potassium thiocyanate, chloroauric acid, sodium thiosulfate and N,N-dimethylselenourea were added to thereby effect optimum chemical sensitization. At the completion of chemical sensitization, compound 13 and compound 14 were added. The terminology "optimum chemical sensitization" used herein means that the addition amount of sensitizing dye or each compound has been selected so as to fall within the range of $10^{-1}$ to $10^{-8}$ mol per mol of silver halide.

Compound 11

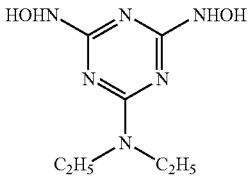

Compound 12

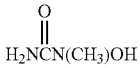

Sensitizing dye 11

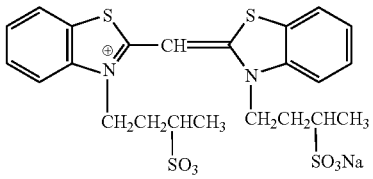

Sensitizing 12

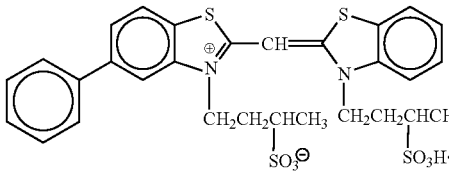

Compound 13

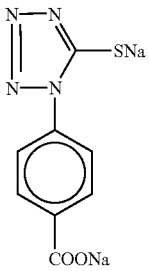

-continued

Compound 14

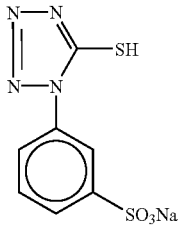

(Manufacturing Method of Em-B)

1,192 mL of an aqueous solution containing 0.96 g of low-molecular-weight gelatin and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double-jet method. After 1.2 g of KBr were added, the temperature was raised to 75° C. to ripen the material. After the ripening, 35 g of trimellitated gelatin with a molecular weight of 100,000, formed by chemically modifying an amino group with trimellitic acid, were added, and the pH was adjusted to 7.6 mg of thiourea dioxide were added. 116 mL of an aqueous solution containing 29 g of $AgNO_3$ and an aqueous KBr solution were added by the double-jet method while the flow rates were accelerated such that the final flow rates were 3 times the initial flow rates. During the addition, the silver potential was held at −20 mV with respect to a saturated calomel electrode. 440.6 mL of an aqueous solution containing 110.2 g of $AgNO_3$ and an aqueous KBr solution were added over 30 min by the double-jet method while the flow rates were accelerated such that the final flow rates were 5.1 times the initial flow rates. During the addition, the AgI fine-grain emulsion used in the preparation of Em-A was simultaneously added at an accelerated flow rate so that the silver iodide content was 15.8 mol %. Also, the silver potential was held at 0 mV with respect to the saturated calomel electrode. 96.5 mL of an aqueous solution containing 24.1 g of $AgNO_3$ and an aqueous KBr solution were added over 3 min by the double-jet method. During the addition, the silver potential was held at 0 mV. After 26 mg of sodium ethylthiosulfonate were added, the temperature was lowered to 55° C., and an aqueous KBr solution was added to adjust the silver potential to −90 mV. The aforementioned AgI fine-grain emulsion was added in an amount of 8.5 g as a KI weight. Immediately after the addition, 228 mL of an aqueous solution containing 57 g of $AgNO_3$ were added over 5 min. During the addition, an aqueous KBr solution was used to adjust the potential at the end of the addition to +20 mV. The resultant emulsion was washed with water and chemically sensitized in substantially the same manner as for Em-A.

(Manufacturing Method of Em-C)

1,192 mL of an aqueous solution containing 1.02 g of phthalated gelatin, which contained 35 μmol of methionine per g and had a molecular weight of 100,000 and a phthalation ratio of 97%, and 0.9 g of KBr were vigorously stirred at 35C. 42 mL of an aqueous solution containing 4.47 g of $AgNO_3$ and 42 mL of an aqueous solution containing 3.16 g of KBr were added over 9 sec by the double-jet method. After 2.6 g of KBr were added, the temperature was raised to 63° C. to ripen the material. After the ripening, 41.2 g of trimellitated gelatin with a molecular weight of 100,000, which was used in the preparation of Em-B, and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double-jet method while the flow rates were accelerated such that the final flow rates were 3.8 times the initial flow rates. During the addition, the silver potential was held at −30 mV with respect to a saturated calomel electrode.

440.6 mL of an aqueous solution containing 110.2 g of $AgNO_3$ and an aqueous KBr solution were added over 24 min by the double-jet method while the flow rates were accelerated such that the final flow rates were 5.1 times the initial flow rates. During the addition, the AgI fine-grain emulsion used in the preparation of Em-A was simultaneously added at an accelerated flow rate so that the silver iodide content was 2.3 mol %. Also, the silver potential was held at −20 mV with respect to the saturated calomel electrode. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double-jet method.

During the addition, the silver potential was held at 10 mV. An aqueous KBr solution was added to adjust the silver potential to −70 mV. The aforementioned AgI fine-grain emulsion was added in an amount of 6.4 g as a KI weight. Immediately after the addition, 404 mL of an aqueous solution containing 57 g of $AgNO_3$ were added over 45 min. During the addition, an aqueous KBr solution was used to adjust the silver potential at the end of the addition to −30 mV. The resultant emulsion was washed with water and chemically sensitized in substantially the same manner as for Em-A.

(Manufacturing Method of Em-D)

In the preparation of Em-C, the $AgNO_3$ addition amount during nucleation was increased by 2.3 times. Also, in the final addition of 404 mL of an aqueous solution containing 57 g of $AgNO_3$, the silver potential at the end of the addition was adjusted to +90 mV by using an aqueous KBr solution. Em-D was prepared following substantially the same procedures as for Em-C except the foregoing.

(Manufacturing Method of Em-E)

1,200 mL of an aqueous solution containing 0.75 g of low-molecular-weight gelatin with a molecular weight of 15,000, 0.9 g of KBr, and 0.2 g of the modified silicone oil used in the preparation of Em-A were held at 39° C. and stirred with violence at pH 1.8. An aqueous solution containing 0.45 g of $AgNO_3$ and an aqueous KBr solution containing 1.5 mol % of KI were added over 16 sec by the double-jet method. During the addition, the excess KBr concentration was held constant. The temperature was raised to 54° C. to ripen the material. After the ripening, 20 g of phthalated gelatin containing 35 μmol of methionine per g and having a molecular weight of 100,000 and a phthalation ratio of 97% were added. After the pH was adjusted to 5.9, 2.9 g of KBr were added. 288 mL of an aqueous solution containing 28.8 g of $AgNO_3$ and an aqueous KBr solution were added over 53 min by the double-jet method. During the addition, the AgI fine-grain emulsion used in the preparation of Em-A was simultaneously added such that the silver iodide content was 4.1 mol %. Also, the silver potential was held at −60 mV with respect to a saturated calomel electrode. After 2.5 g of KBr were added, an aqueous solution containing 87.7 g of $AgNO_3$ and an aqueous KBr solution were added over 63 min by the double-jet method while the flow rate was accelerated so that the final flow rate was 1.2 times the initial flow rate. During the addition, the abovementioned AgI fine-grain emulsion was simultaneously added at an accelerated flow rate such that the silver iodide content was 10.5 mol %. Also, the silver potential was held at −70 mV.

After 1 mg of thiourea dioxide was added, 132 mL of an aqueous solution containing 41.8 g of $AgNO_3$ and an aqueous KBr solution were added over 25 min by the double-jet method. The addition of the aqueous KBr solution was so adjusted that the silver potential at the end of the addition was +20 mV. After 2 mg of sodium benzenethiosulfonate were added, the pH was adjusted to 7.3, and KBr was added to adjust the silver potential to −70 mV. After that, the aforementioned AgI fine-grain emulsion was added in an amount of 5.73 g as a KI weight. Immediately after the addition, 609 mL of an aqueous solution containing 66.4 g of $AgNO_3$ were added over 10 min. For the first 6 min of the addition, the silver potential was held at −70 mV by an aqueous KBr solution. After washing with water, gelatin was added, and the pH and the pAg were adjusted to 6.5 and 8.2, respectively, at 40° C. Compounds 11 and 12 were added, and the temperature was raised to 56° C. After 0.0004 mol of the aforementioned AgI fine-grain emulsion was added per mol of silver, sensitizing dyes 13 and 14 were added. The emulsion was optimally, chemically sensitized by adding potassium thiocyanate, chloroauric acid, sodium thiosulfate, and N,N-dimethylselenourea. At the end of the chemical sensitization, compounds 13 and 14 were added.

Sensitizing dye 13

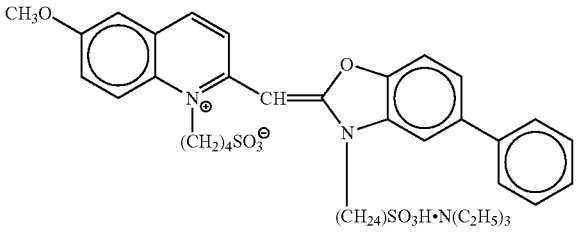

Sensitizing dye 14

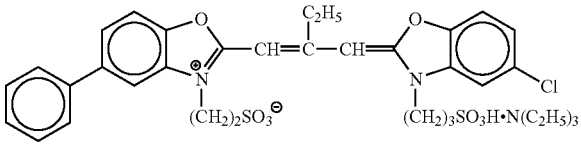

(Manufacturing Method of Em-F)

Em-F was prepared following substantially the same procedures as for Em-E except that the $AgNO_3$ addition amount during the nucleation was increased 4.12 times. Note that the sensitizing dyes in Em-E were changed to sensitizing dyes 12, 15, 16, and 17.

Sensitizing dye 15

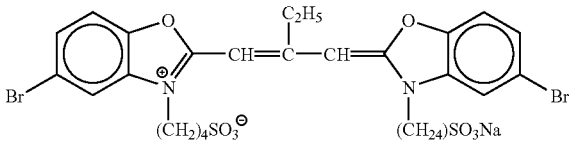

-continued

Sensitizing dye 16

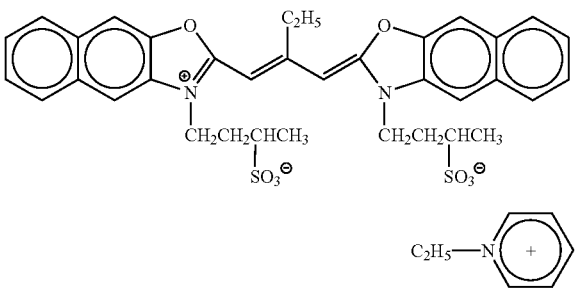

Sensitizing dye 17

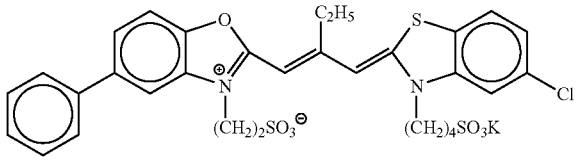

(Manufacturing Method of Em-G)

1,200 mL of an aqueous solution containing 0.70 g of low-molecular-weight gelatin with a molecular weight of 15,000, 0.9 g of KBr, 0.175 g of KI, and 0.2 g of the modified silicone oil used in the preparation of Em-A were held at 33° C. and stirred with violence at pH 1.8. An aqueous solution containing 1.8 g of $AgNO_3$ and an aqueous KBr solution containing 3.2 mol % of KI were added over 9 sec by the double-jet method. During the addition, the excess KBr concentration was held constant. The temperature was raised to 62° C. to ripen the material. After the ripening, 27.8 g of trimellitated gelatin containing 35 μmol of methionine per g and having a molecular weight of 100,000, which was formed by chemically modifying an amino group with trimellitic acid, were added. After the pH was adjusted to 6.3, 2.9 g of KBr were added. 270 mL of an aqueous solution containing 27.58 g of $AgNO_3$ and an aqueous KBr solution were added over 37 min by the double-jet method. During the addition, an AgI fine-grain emulsion having a grain size of 0.008 μm was simultaneously added such that the silver iodide content was 4.1 mol %. This AgI fine-grain emulsion was prepared, immediately before the addition, by mixing an aqueous solution of low-molecular-weight gelatin with a molecular weight of 15,000, an aqueous $AgNO_3$ solution, and an aqueous KI solution in another chamber having a magnetic coupling induction type stirrer described in JP-A-10-43570. Also, the silver potential was held at −60 mV with respect to a saturated calomel electrode.

After 2.6 g of KBr were added, an aqueous solution containing 87.7 g of $AgNO_3$ and an aqueous KBr solution were added over 49 min by the double-jet method while the flow rates were accelerated so that the final flow rates were 3.1 times the initial flow rates. During the addition, the aforementioned AgI fine-grain emulsion prepared by mixing immediately before addition was simultaneously added at an accelerated flow rate such that the silver iodide content was 7.9 mol %. Also, the silver potential was held at −70 mV. After 1 mg of thiourea dioxide was added, 132 mL of an aqueous solution containing 41.8 g of $AgNO_3$ and an aqueous KBr solution were added over 20 min by the double-jet method. The addition of the aqueous KBr solution was so adjusted that the potential at the end of the addition was +20 mV. After the temperature was raised to 78° C. and the pH was adjusted to 9.1, KBr was added to adjust the potential to −60 mV. The AgI fine-grain emulsion used in the preparation of Em-A was added in an amount of 5.73 g as a KI weight. Immediately after the addition, 321 mL of an aqueous solution containing 66.4 g of $AgNO_3$ were added over 4 min. For the first 2 min of the addition, the silver potential was held at −60 mV by an aqueous KBr solution. The resultant emulsion was washed with water and chemically sensitized in substantially the same manner as for Em-F.

(Manufacturing Method of Em-H)

An aqueous solution containing 17.8 g of ion-exchanged gelatin with a molecular weight of 100,000, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double-jet method. After the temperature was raised to 63° C., 24.1 g of ion-exchanged gelatin with a molecular weight of 100,000 were added to ripen the material. After the ripening, an aqueous solution containing 133.4 g of $AgNO_3$ and an aqueous KBr solution were added over 20 min by the double-jet method such that the final flow rate was 2.6 times the initial flow rate. During the addition, the silver potential was held at +40 mV with respect to a saturated calomel electrode.

Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double-jet method. During the addition, the silver potential was held at +90 mV with respect to the saturated calomel electrode. Also, over 6 min from the start of the addition, 100 mL of an aqueous solution containing 29 mg of yellow prussiate of potash were added. After 14.4 g of KBr were added, the AgI fine-grain emulsion used in the preparation of Em-A was added in an amount of 6.3 g as a KI weight. Immediately after the addition, an aqueous solution containing 42.7 g of $AgNO_3$ and an aqueous KBr solution were added over 11 min by the double-jet method. During the addition, the silver potential was held at +90 mV. The resultant emulsion was washed with water and chemically sensitized in substantially the same manner as for Em-F.

(Manufacturing Method of Emulsion Em-I)

Em-I was prepared following substantially the same procedures as for Em-H except that the nucleation temperature was changed to 35° C.

(Manufacturing Method of Emulsion Em-J)

1,200 mL of an aqueous solution containing 0.38 g of phthalated gelatin with a phthalation ratio of 97% and a molecular weight of 100,000 and 0.9 g of KBr were held at 60° C. and stirred with violence at pH 2. An aqueous solution containing 1.96 g of $AgNO_3$ and an aqueous solution containing 1.67 g of KBr and 0.172 g of KI were added over 30 sec by the double-jet method. After ripening, 12.8 g of trimellitated gelatin containing 35 μmol of methionine per g and having a molecular weight of 100,000, which was formed by chemically modifying an amino group with trimellitic acid, were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 31 min by the double-jet method. During the addition, the silver potential was held at −50 mV with respect to a saturated calomel electrode. An aqueous solution containing 65.6 g of $AgNO_3$ and an aqueous KBr solution were added over 37 min by the double-jet method while the flow rates were accelerated so that the final flow rates were 2.1 times the initial flow rates. During the addition, the AgI fine-grain emulsion used in the preparation of Em-A was simultaneously added at an accelerated flow rate such that the silver iodide content was 6.5 mol %. Also, the silver potential was held at −50 mV.

After 1.5 mg of thiourea dioxide were added, 132 mL of an aqueous solution containing 41.8 g of $AgNO_3$ and an aqueous KBr solution were added over 13 min by the double-jet method. The addition of the aqueous KBr solution was so adjusted that the silver potential at the end of the addition was +40 mV. After 2 mg of sodium benzenethiosulfonate were added, KBr was added to adjust the silver potential to −100 mV. The abovementioned AgI fine-grain emulsion was added in an amount of 6.2 g as a KI weight. Immediately after the addition, 300 mL of an aqueous solution containing 88.5 g of $AgNO_3$ were added over 8 min. An aqueous KBr solution was added to adjust the potential at the end of the addition to +60 mV. After washing with water, gelatin was added, and the pH and the pAg were adjusted to 6.5 and 8.2, respectively. After compounds 11 and 12 were added, the temperature was raised to 61° C. Sensitizing dyes 18, 19, 20, and 21 were added. After that, the emulsion was optimally, chemically sensitized by adding $K_2IrCl_6$, potassium thiocyanate, chloroauric acid, sodium thiosulfate, and N,N-dimethylselenourea. At the end of the chemical sensitization, compounds 13 and 14 were added.

Sensitizing dye 18

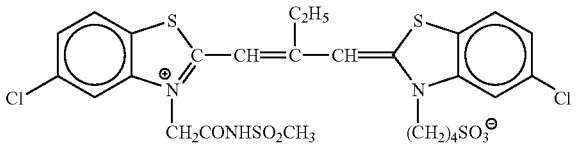

Sensitizing dye 19

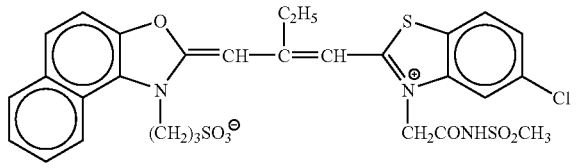

-continued

Sensitizing dye 20

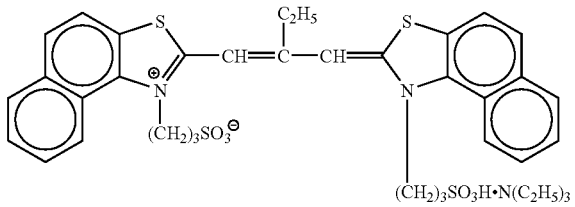

Sensitizing dye 21

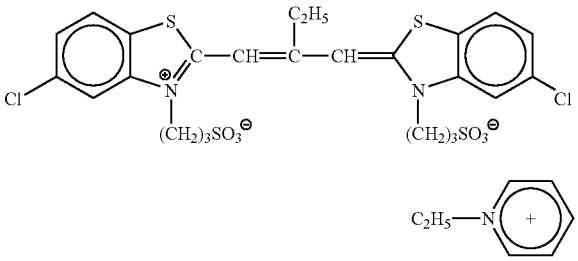

(Manufacturing Method of Em-K)

1,200 mL of an aqueous solution containing 4.9 g of low-molecular-weight gelatin with a molecular weight of 15,000 and 5.3 g of KBr were vigorously stirred at 60° C. 27 mL of an aqueous solution containing 8.75 g of $AgNO_3$ and 36 mL of an aqueous solution containing 6.45 g of KBr were added over 1 min by the double-jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double-jet method such that the final flow rates were 4 times the initial flow rates. The temperature was lowered to 55° C., and 240 mL of an aqueous solution containing 7.1 g of $AgNO_3$ and an aqueous solution containing 6.46 g of KI were added over 5 min by the double-jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double-jet method. The resultant emulsion was washed with water and chemically sensitized in substantially the same manner as for Em-J.

(Manufacturing Method of Em-L)

Em-L was prepared following substantially the same procedures as for Em-K except that the nucleation temperature was changed to 40° C.

(Manufacturing Method of Em-M)

Em-M was prepared following substantially the same procedures as for Em-J except that chemical sensitization was performed in substantially the same manner as for Em-F.

The characteristic values of silver halide emulsions Em-A to Em-M are summarized in Table 9.

TABLE 9

| Emulsion No. | E.C.D.[1] (μm) C.O.V.[2] (%) | Thickness (μm) C.O.V.[2] (%) | A.R.[3] C.O.V.[2] (%) | Tabularity | Twin plane distance (μm) C.O.V.[2] (%) | Ratio of tabular grains[4] (%) | (100) Face ratio to the side faces (%) | I content (mol %) C.O.V.[2] (%) | Cl content (mol %) | Surface I content (mol %) |
|---|---|---|---|---|---|---|---|---|---|---|
| Em-A | 1.98 | 0.198 | 10 | 51 | 0.014 | 92 | 23 | 15 | 0 | 4.3 |
| | 23 | 28 | 35 | | 32 | | | 17 | | |
| Em-B | 1.30 | 0.108 | 12 | 111 | 0.013 | 93 | 22 | 11 | 0 | 3.6 |
| | 25 | 27 | 38 | | 30 | | | 16 | | |
| Em-C | 1.00 | 0.083 | 12 | 145 | 0.012 | 93 | 18 | 4 | 1 | 1.8 |
| | 27 | 26 | 37 | | 30 | | | 8 | | |
| Em-D | 0.75 | 0.075 | 10 | 133 | 0.010 | 91 | 33 | 4 | 2 | 1.9 |
| | 31 | 18 | 29 | | 27 | | | 8 | | |
| Em-E | 2.02 | 0.101 | 20 | 198 | 0.013 | 99 | 20 | 7 | 0 | 2.4 |
| | 31 | 19 | 42 | | 33 | | | 7 | | |
| Em-F | 1.54 | 0.077 | 20 | 260 | 0.013 | 99 | 23 | 7 | 0 | 2.5 |
| | 26 | 18 | 33 | | 26 | | | 7 | | |
| Em-G | 1.08 | 0.072 | 15 | 208 | 0.008 | 97 | 23 | 6 | 0 | 2.0 |
| | 18 | 15 | 19 | | 22 | | | 5 | | |
| Em-H | 0.44 | 0.22 | 2 | 9 | 0.013 | 90 | 38 | 3 | 2 | 1 |
| | 16 | 13 | 9 | | 18 | | | 6 | | |
| Em-I | 0.33 | 0.165 | 2 | 12 | 0.013 | 88 | 42 | 3 | 2 | 1 |
| | 17 | 13 | 12 | | 18 | | | 6 | | |
| Em-J | 1.83 | 0.122 | 15 | 123 | 0.012 | 98 | 23 | 5 | 1 | 1.8 |
| | 18 | 20 | 22 | | 19 | | | 6 | | |
| Em-K | 1.09 | 0.156 | 7 | 45 | 0.013 | 99 | 22 | 3 | 0 | 2.7 |
| | 16 | 18 | 19 | | 16 | | | 7 | | |
| Em-L | 0.84 | 0.120 | 7 | 58 | 0.013 | 99 | 25 | 3 | 0 | 2.7 |
| | 17 | 18 | 19 | | 16 | | | 7 | | |
| Em-M | 1.83 | 0.122 | 15 | 123 | 0.012 | 98 | 23 | 5 | 1 | 1.8 |
| | 18 | 20 | 22 | | 19 | | | 6 | | |

[1]E.C.D. = Equivalent Circle Diameter
[2]C.O.V. = Coefficient of Variation
[3]A.R. = Aspect Ratio
[4]Ratio of Tabular Grains = Ratio of tabular grains to the total projected area 1) Support A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.)

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω.cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-y-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2HsC(CH_2OCONH{-}C_6H_3(CH_3)NCO)_3$ as a hardener and acetone, methylethylketone, and cyclohexane as solvents, thereby forming a 1.2 μm thick magnetic recording layer. 10 mg/m$^2$ of silica grains (0.3 μm) were added as a matting agent, and 10 mg/m$^2$ of aluminum oxide (0.15 μm) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 $Am^2/kg$, $7.3\times10^4$ A/m, and 65%, respectively.

3-3) Preparation of Slip Layer

The surface was then coated with diacetylcellulose (25 $mg/m^2$) and a mixture of $C_6H_{13}CH(OH)C_{10}H_{20}COOC_{40}H_{81}$ (compound a, 6 $mg/m^2$)/$C_{50}H_{101}O(CH_2CH_2O)_{16}H$ (compound b, 9 $mg/m^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 μm) in acetone before being added. 15 $mg/m^2$ of silica grains (0.3 μm) were added as a matting agent, and 15 $mg/m^2$ of aluminum oxide (0.15 μm) coated with 3-poly(polymerization degree 15)oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmϕ stainless steel hard sphere, load 10 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to form Sample 201 as a color negative sensitized material.

(Compositions of Sensitive Layers)

The main ingredients used in the individual layers are classified as follows, however, the use thereof are not limited to those specified below.

ExC: Cyan coupler UV: Ultraviolet absorbent

ExM: Magenta coupler HBS: High-boiling organic solvent

ExY: Yellow coupler H: Gelatin hardener (In the following description, practical compounds have numbers attached to their symbols. Formulas of these compounds will be presented later.)

The number corresponding to each component indicates the coating amount in units of $g/m^2$. The coating amount of a silver halide is indicated by the amount of silver.

| | | |
|---|---|---|
| 1st layer (1st antihalation layer) | | |
| Black colloidal silver | silver | 0.155 |
| Surface-fogged AgBrI emulsion (2) of 0.02 μm | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| 2nd layer (2nd antihalation layer) | | |
| Black colloidal silver | silver | 0.066 |
| Gelatin | | 0.407 |
| ExM-1 | | 0.050 |
| ExF-1 | | $2.0\times10^{-3}$ |
| HBS-1 | | 0.074 |
| Solid disperse dye ExF-2 | | 0.015 |
| Solid disperse dye ExF-3 | | 0.020 |

-continued

| | | |
|---|---|---|
| 3rd layer (Interlayer) | | |
| AgBrI emulsion (2) of 0.07 μm | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Emulsion a of Example 2 | silver | 0.323 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Em-K | silver | 0.21 |
| Em-L | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Em-J | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-1 | | 0.050 |
| Polyethylacrylate latex | | 0.83 |
| Gelatin | | 0.84 |
| 8th layer (layer for donating interimage effect to red-sensitive layer) | | |
| Em-E | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Em-G | silver | 0.39 |
| Em-H | silver | 0.28 |
| Em-I | silver | 0.35 |
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |

-continued

| | | |
|---|---|---|
| 10th layer (Medium-speed green-sensitive emulsion layer) | | |
| Em-F | silver | 0.29 |
| Em-G | silver | 0.25 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Em-M | silver | 0.99 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.047 |
| Cpd-1 | | 0.16 |
| Oil-soluble dye ExF-5 | | 0.010 |
| Solid disperse dye ExF-6 | | 0.010 |
| HBS-1 | | 0.082 |
| Gelatin | | 1.057 |
| 13th layer (Low-speed blue-sensitive emulsion layer) | | |
| Em-B | silver | 0.18 |
| Em-C | silver | 0.20 |
| Em-D | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Em-A | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| AgBrI emulsion (2) of 0.07 μm silver | | 0.30 |
| UV-1 | | 0.21 |
| UV-2 | | 0.13 |
| UV-3 | | 0.20 |
| UV-4 | | 0.025 |
| F-18 | | 0.009 |
| F-19 | | 0.005 |
| F-20 | | 0.005 |
| HBS-1 | | 0.12 |
| HBS-4 | | $5.0 \times 10^{-2}$ |
| Gelatin | | 2.3 |

-continued

| | |
|---|---|
| 16th layer (2nd protective layer) | |
| H-1 | 0.40 |
| B-1 (diameter 1.7 μm) | $5.0 \times 10^{-2}$ |
| B-2 (diameter 1.7 μm) | 0.15 |
| B-3 | 0.05 |
| S-1 | 0.20 |
| Gelatin | 0.75 |

In addition to the above components, to improve the storagebility, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Samples 201 to 203 were prepared by replacing Emulsion a(1) of Example 2 in the 4th layer with Emulsion a(2) or Emulsion a(3).

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.Og of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K.K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.24 μm.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was found to be 0.06 μm.

A solid dispersion ExF-6 was dispersed by the following method.

4.0 Kg of water and 376 g of a 3% solution of W-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min. The average grain size was 0.52 μm.

The compounds used in the formation of each layer are as follows.

ExC-1
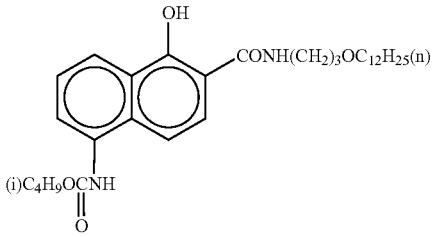
ExC-2
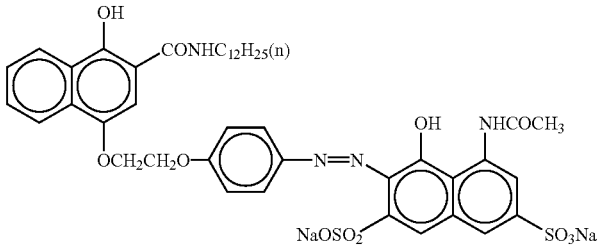
ExC-3
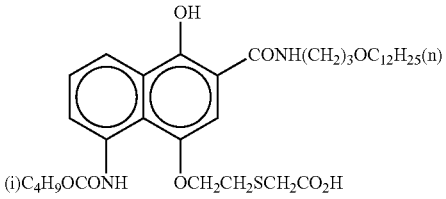
ExC-4
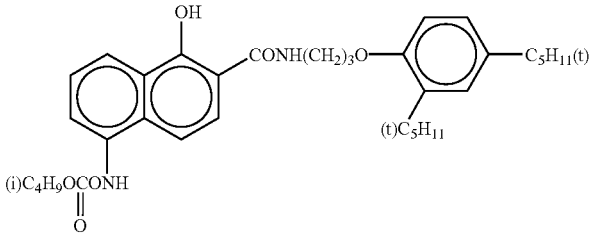
ExC-5
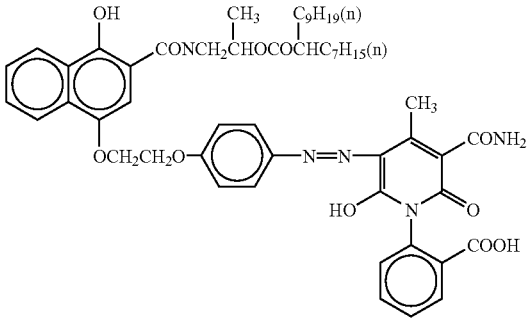
ExC-6
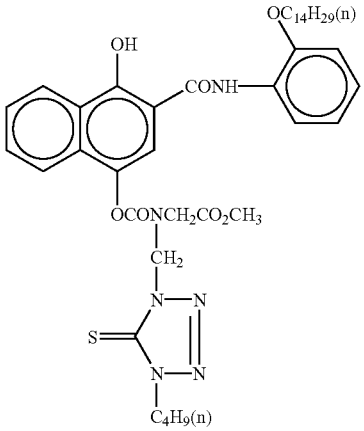
ExC-7
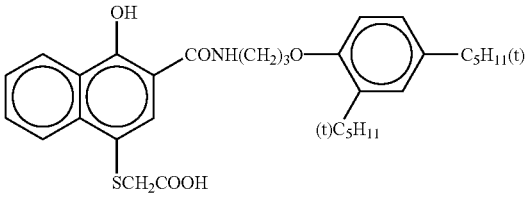
ExC-8
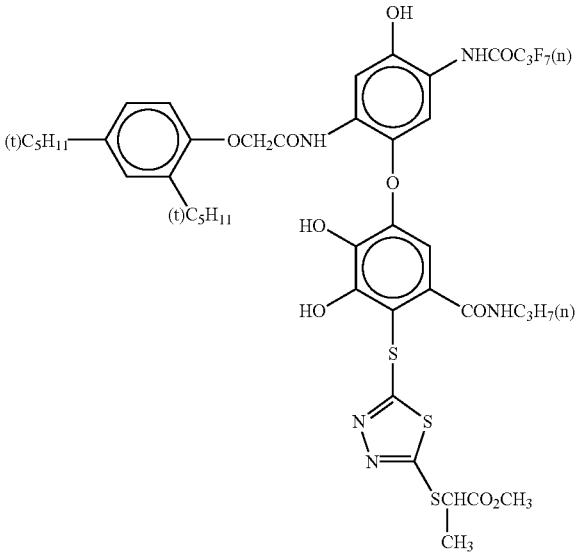

-continued
ExM-1
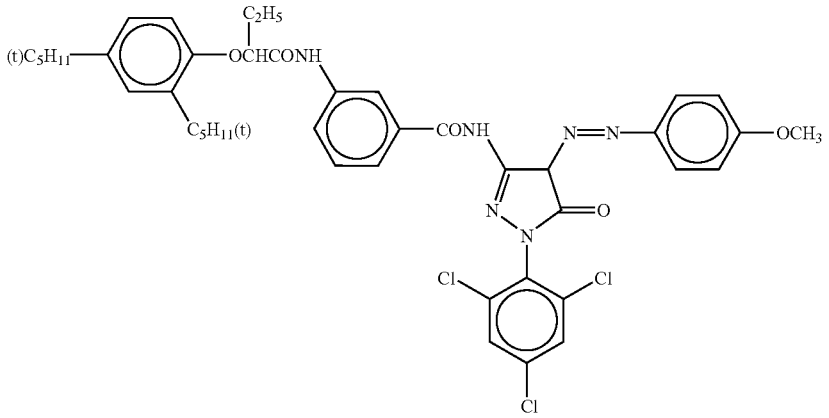
ExM-2
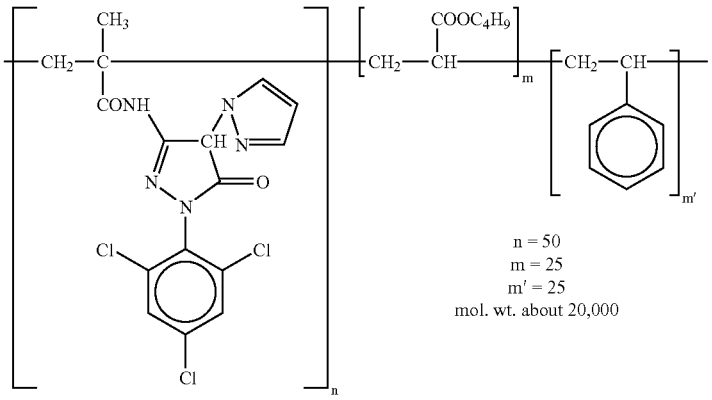
n = 50
m = 25
m′ = 25
mol. wt. about 20,000
ExM-3
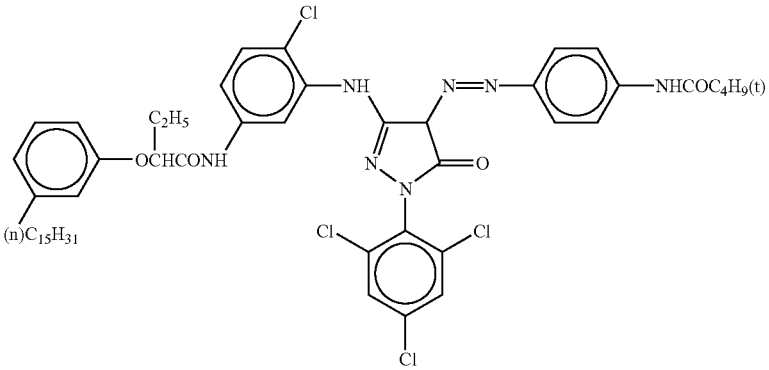
ExM-4
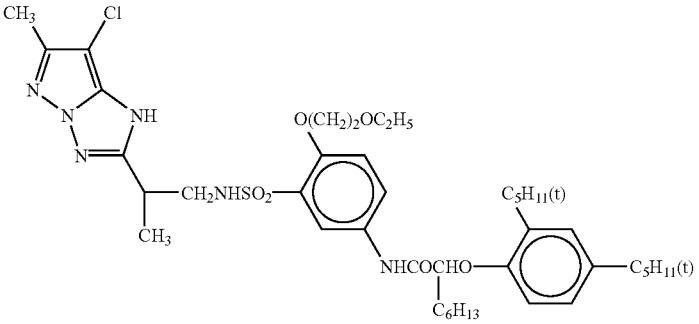

-continued
ExM-5
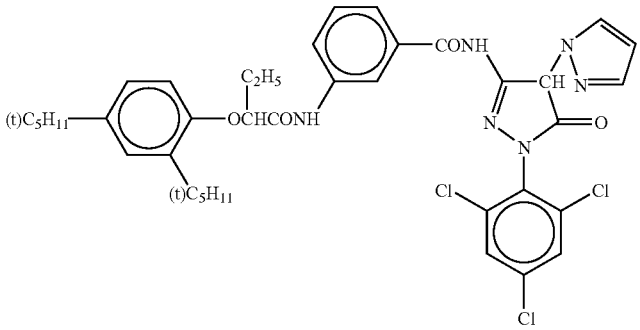
ExY-1
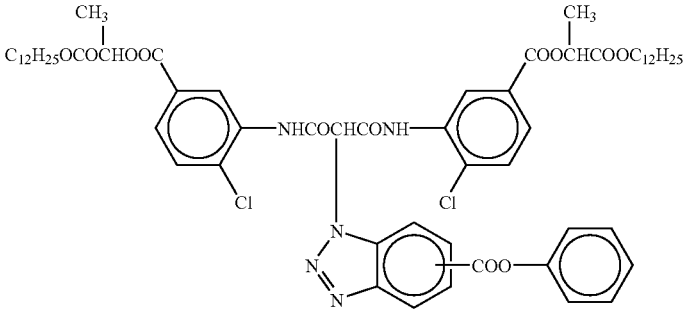
ExY-2
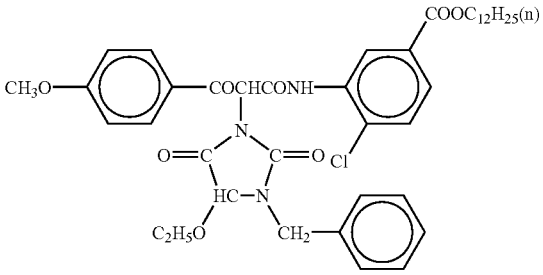
ExY-3
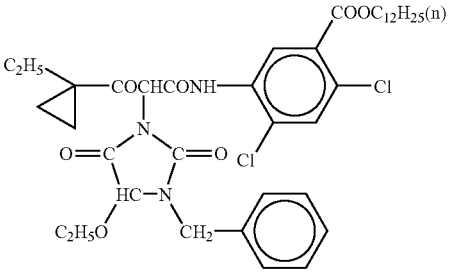
ExY-4
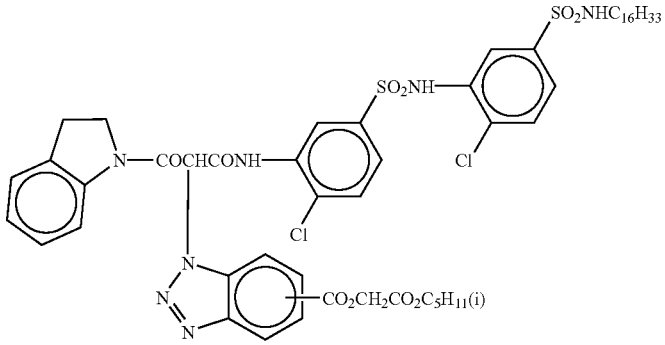

-continued
ExY-5
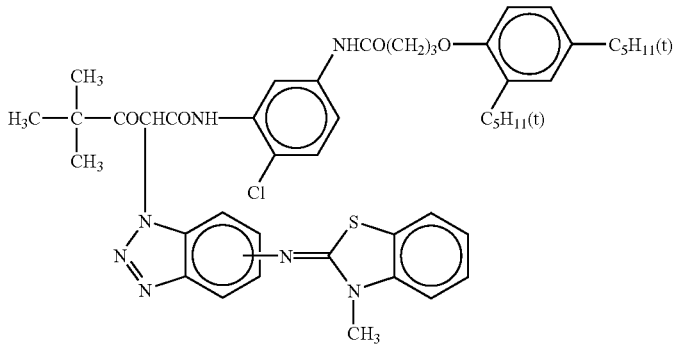
Exy-6
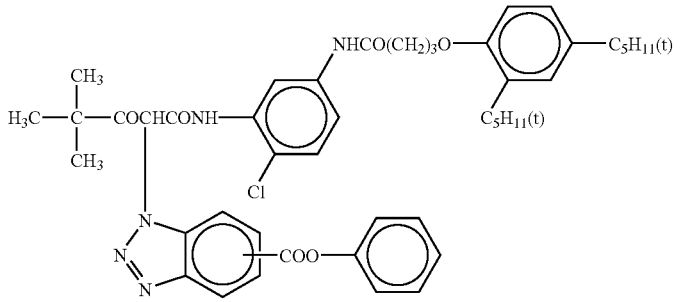
ExG-1
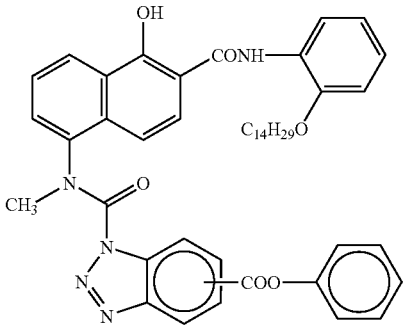
ExF-1
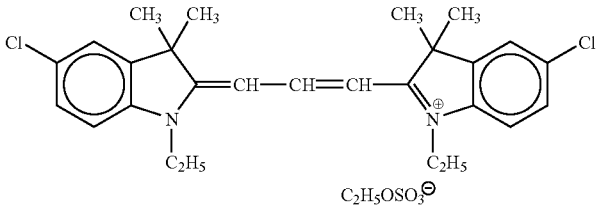
ExF-2
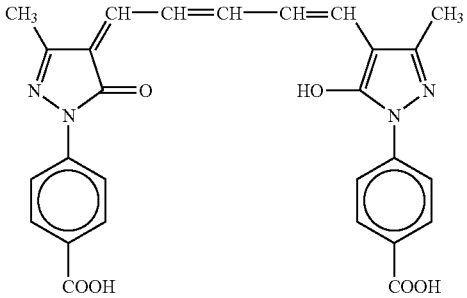

-continued
ExF-3
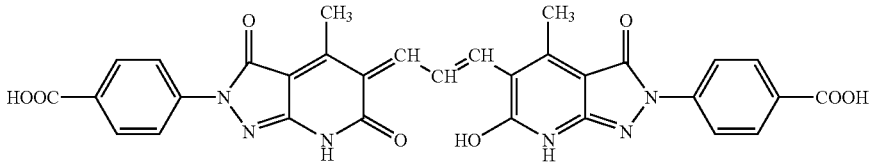
ExF-4
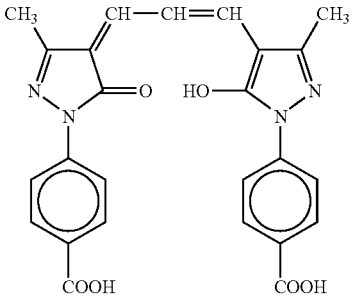
ExF-5
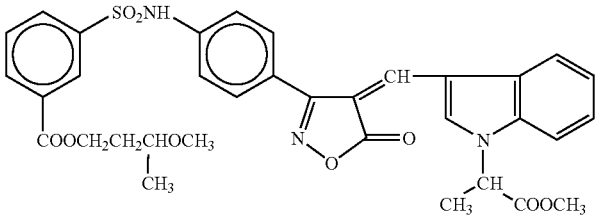
ExF-6
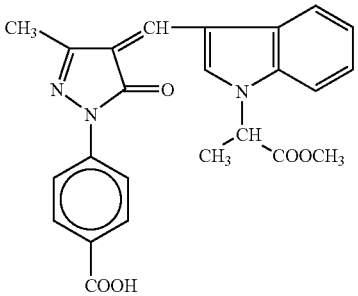
Cpd-1
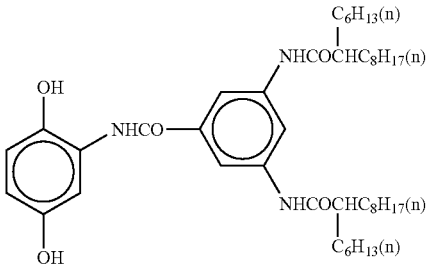
Cpd-2
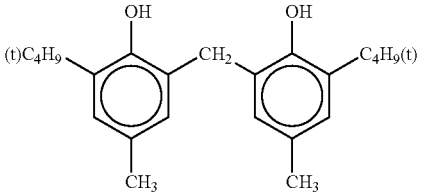
Cpd-3
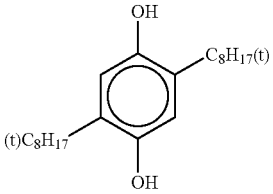
Cpd-4
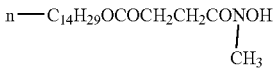
UV-1
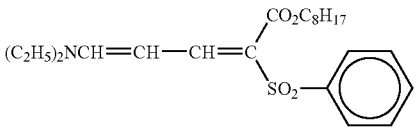
UV-2
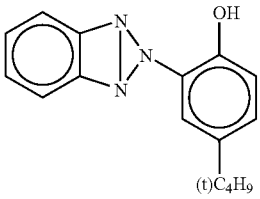
UV-3
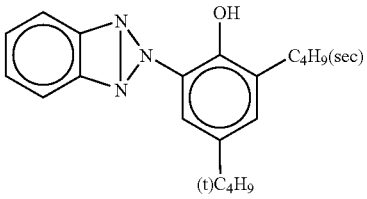

-continued
UV-4
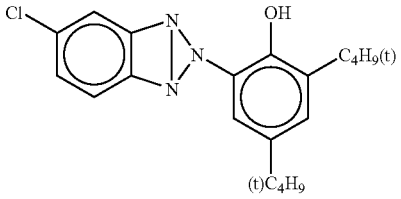
HBS-1
Tricresyl phosphate
HBS-2
Di-n-butyl phthalate
HBS-3
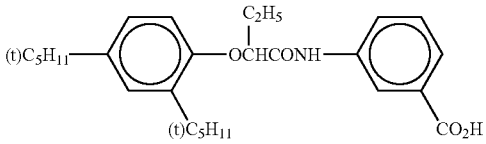
HBS-4
Tri (2-ethylhexyl) phosphate
H-1
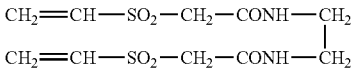
S-1
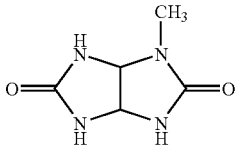
B-1
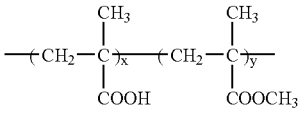
x/y = 10/90 (wt. ratio)
Av. mol. wt.: about 35,000
B-2
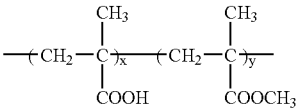
x/y = 40/60 (wt. ratio)
Av. mol. wt.: about 20,000
B-3
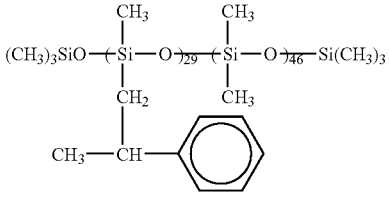
(Mol ratio)
Av. mol wt.: about 8,000
B-4
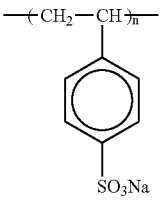
Av. mol. wt.: about 750,000
B-5
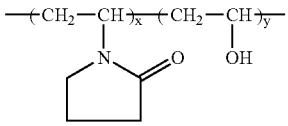
x/y = 70/30 (wt. ratio)
Av. mol. wt.: about 17,000
B-6
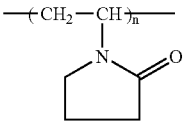
Av. mol. wt.: about 10,000
W-1
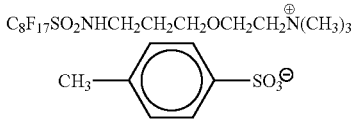
W-2
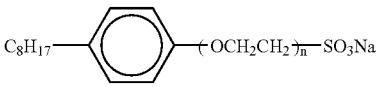
n = 2-4
W-3
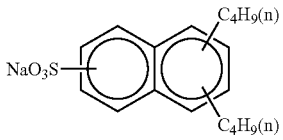
W-4
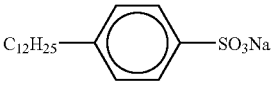
W-5
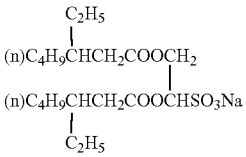

-continued
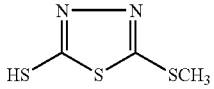
F-1
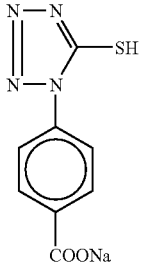
F-2
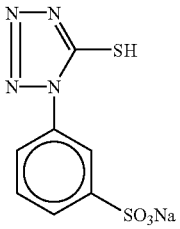
F-3
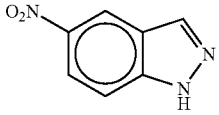
F-4
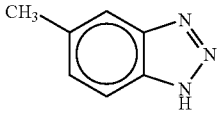
F-5
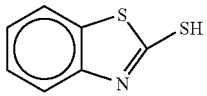
F-6
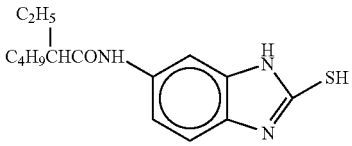
F-7
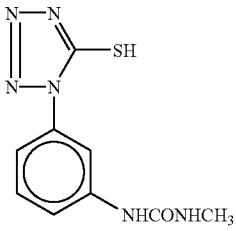
F-8
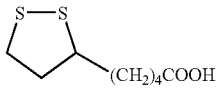
F-9
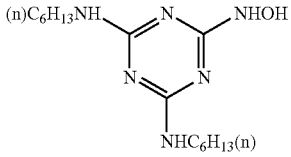
F-10
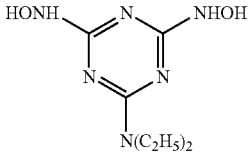
F-11
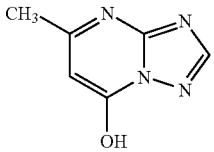
F-12
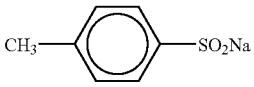
F-13
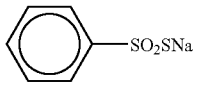
F-14
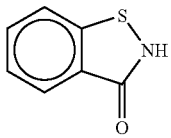
F-15
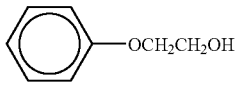
F-16

-continued

F-17

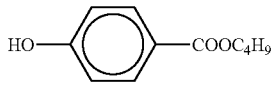

F-18

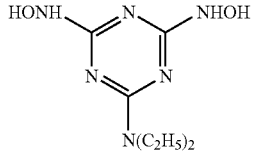

F-19

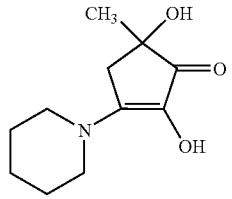

F-20

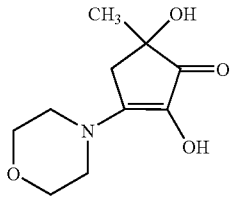

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing Steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each cross-over time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | <Tank solution> (g) | <Replenisher> (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl) amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution pH 6.8

| (Fixer (2)) | <Tank solution> (g) | <Replenisher> (g) |
|---|---|---|
| Ammonium thiosulfate (750 g/L) | 240 mL | 720 mL |
| Imidazole | 7 | 21 |

-continued

| (Fixer (2)) | <Tank solution> (g) | <Replenisher> (g) |
|---|---|---|
| Ammonium Methanthiosuifonate | 5 | 15 |
| Ammonium Methanesulfinate | 10 | 30 |
| Ethylenediamine tetraacetic acid | 13 | 39 |
| Water to make | 1.0 L | 1.0 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

The same processing as above, but the replenishing amount of the developing solution was reduced by half was carried out. The results are set forth in Table 10.

TABLE 10

| Sample No. | Emulsion | Standard development Sensitivity* | Half replenishment Sensitivity* |
|---|---|---|---|
| 201 | a (1) (Comp.) | 100 | 64 |
| 202 | a (2) (Inv.) | 238 | 195 |
| 203 | a (3) (Inv.) | 256 | 213 |

*Sensitivity at fog plus density of 2.0

As is apparent from Table 10, photographic materials having high sensitivity and whose development dependency was improved can be obtained by using the emulsion of the present invention in a low-speed layer.

What is claimed is:

1. A silver halide photographic emulsion comprising silver halide grains, wherein a variation coefficient of equivalent-circle diameters of all the silver halide grains is 30% or less, and 70% or more of the total projected area of the silver halide grains are occupied by silver halide grains each meeting requirements (i), (ii), (iii) and (viii) below:

(i) silver bromochloroiodide tabular grain having (111) faces as main planes, (ii) having an epitaxial portion junctioned to at least one apex portion thereof, (iii) having at least one mesh-like dislocation line in an epitaxial portion thereof, and (viii) hexagonal tabular grain in which the ratio of the length of an edge having a maximum length to the length of an edge having a minimum length is 2 or less.

2. The silver halide photographic emulsion according to claim 1, wherein the epitaxial portions defined in the requirement (ii) are junctioned to all the apex portions of the grain.

3. The silver halide photographic emulsion according to claim 1, wherein each of the grains occupying the 70% or more of the total projected area further meeting requirement (iv) below:

(iv) having no dislocation lines in portions except for the epitaxial portions thereof.

4. The silver halide photographic emulsion according to claim 2, wherein each of the grains occupying the 70% or more of the total projected area further meeting requirement (iv) below:

(iv) having no dislocation lines in portions except for the epitaxial portions thereof.

5. The silver halide photographic emulsion according to claim 1, wherein each of the grains occupying the 70% or more of the total projected area further meeting requirements (v), (vi), and (vii) below:

(v) the equivalent-circle diameter is 0.3 to 1.2 μm, (vi) the silver chloride content is 1 to 6 mol %, and (vii) an amount of an outermost layer thereof containing 10 mol % or more of silver iodide is 20% or less in terms of silver.

6. The silver halide photographic emulsion according to claim 2, wherein each of the grains occupying the 70% or more of the total projected area further meeting requirements (v), (vi), and (vii) below:

(v) the equivalent-circle diameter is 0.3 to 1.2 μm, (vi) the silver chloride content is 1 to 6 mol %, and (vii) an amount of an outermost layer thereof containing 10 mol % or more of silver iodide is 20% or less in terms of silver.

7. The silver halide photographic emulsion according to claim 1, wherein each of the grains occupying the 70% or more of the total projected area further meeting requirement (ix) below:

(ix) the thickness is 0.1 μm or less.

8. The silver halide photographic emulsion according to claim 2, wherein each of the grains occupying the 70% or more of the total projected area further meeting requirement (ix) below:

(ix) the thickness is 0.1 μm or less.

9. The silver halide photographic emulsion according to claim 1, wherein the variation coefficient of the equivalent-circle diameters of all the silver halide grains is 20% or less.

10. The silver halide photographic emulsion according to claim 1, wherein each of the grains occupying the 70% or more of the total projected area further meeting requirement (x) below:

(x) letting CL mol % be the average silver chloride content of all the silver halide grains, the silver chloride content is within a range of 0.7CL to 1.3CL.

11. The silver halide photographic emulsion according to claim 1, wherein each of the grains occupying the 70% or more of the total projected area further meeting requirement (xi) below:

(xi) letting I mol % be the average silver iodide content of all the silver halide grains, the silver iodide content is within a range of 0.7I to 1.3I.

* * * * *